US006873815B2

(12) United States Patent
Matsuda et al.

(10) Patent No.: US 6,873,815 B2
(45) Date of Patent: Mar. 29, 2005

(54) PART OF AN IMAGE FORMING APPARATUS AND A UNIT HAVING A GROOVE COVERED WITH A BRUSH MEMBER

(75) Inventors: Kenji Matsuda, Shizuoka (JP); Akiyoshi Fujita, Shizuoka (JP); Nobuharu Hoshi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 10/106,316

(22) Filed: Mar. 27, 2002

(65) Prior Publication Data

US 2002/0141788 A1 Oct. 3, 2002

(30) Foreign Application Priority Data

Mar. 30, 2001 (JP) ..... 2001-101515

(51) Int. Cl.[7] ..... G03G 15/08
(52) U.S. Cl. ..... 399/260
(58) Field of Search ..... 399/260, 258, 399/262

(56) References Cited

U.S. PATENT DOCUMENTS

| | | | | |
|---|---|---|---|---|
| 5,528,341 | A | 6/1996 | Shishido et al. | 355/200 |
| 5,642,187 | A | 6/1997 | Nomura et al. | 399/111 |
| 5,650,841 | A | 7/1997 | Matsuda et al. | 399/111 |
| 5,678,139 | A | 10/1997 | Nomura et al. | 399/114 |
| 5,697,022 | A | 12/1997 | Matsuda et al. | 399/102 |
| 5,740,499 | A | 4/1998 | Higeta et al. | 399/105 |
| 5,809,374 | A | 9/1998 | Tsuda et al. | 399/111 |
| 5,825,472 | A | 10/1998 | Araki et al. | 355/200 |
| 5,963,759 | A | 10/1999 | Kojima et al. | 399/111 |
| 6,016,408 | A | 1/2000 | Hashimoto et al. | 399/27 |
| 6,078,763 | A | 6/2000 | Hoshi | 399/111 |
| 6,101,352 | A | 8/2000 | Hashimoto et al. | 399/19 |
| 6,151,459 | A | 11/2000 | Hashimoto et al. | 399/27 |
| 6,324,370 | B1 | 11/2001 | Isobe et al. | 399/258 |

FOREIGN PATENT DOCUMENTS

| | | | |
|---|---|---|---|
| JP | 63-194281 | * | 8/1988 |
| JP | 4-42180 | * | 2/1992 |
| JP | 6-332312 | * | 12/1994 |
| JP | 8-15970 | * | 8/1996 |
| JP | 9-274384 | * | 9/1997 |

* cited by examiner

*Primary Examiner*—Quana Grainger
(74) *Attorney, Agent, or Firm*—Fitzpatrick, Cella, Harper & Scinto

(57) ABSTRACT

In conventional image forming apparatus, there is a type of a printer in which a developing device and a developer supplying container are separately provided and the developer supplying container is replaced individually to supply a developer that is an expendable agent. The printer of this type has an advantage that it is unecessary to replace frequently the component having a relatively long durable life, while the printer has the disadvantage that leakage of the developer easily occurs when the developer supplying container is removed from the printer main body. Therefore, an image forming apparatus capable of controlling leakage of developer is provided.

14 Claims, 15 Drawing Sheets

PART OF AN IMAGE FORMING APPARATUS AND A UNIT HAVING A GROOVE COVERED WITH A BRUSH MEMBER

BACKGROUND OF THE INVENTION

1. Field of the Invention

The present invention relates to an image forming apparatus such as a copying machine and a printer, which uses a recording system such as an electrophotographic recording system and an electrostatic recording system, and a developer supplying container detachably attachable to this apparatus.

2. Related Background Art

Many copying machines and printers currently employed are those of a cartridge type that can be easily maintained.

For example, in a printer using the electrophotographic recording technology, a photosensitive body and a developing device are incorporated into one cartridge that is detachably attachable to a printer main body. Alternatively, a photosensitive body and a cleaning device are incorporated into one cartridge and a developing device is attached to and detached from a printer main body as a separate cartridge. Thus, there are a variety of forms of a cartridge.

Among them, there is also a form of a printer in which a developing device and a developer supplying container are separately provided and the developer supplying container is replaced individually to supply a developer that is an, expendable agent. The printer of this type is economical because it is unnecessary to replace components in the developing device, for example, a component with a relatively long durable life such as a developing roller, every time the developer is supplied. In addition, a cartridge can be easily replaced because it is made compact.

However, it is necessary to cope with leakage of the developer when the developer supplying container is removed from the printer main body.

SUMMARY OF THE INVENTION

The present invention has been devised in view of the above-mentioned drawbacks, and it is an object of the present invention to provide an image forming apparatus capable of controlling leakage of developer and a unit detachably attachable to this apparatus.

Another object of the present invention is to provide an image forming apparatus, comprising: a unit detachably attachable to a main assembly of the image forming apparatus, the unit having a discharge opening for discharging a developer and a shutter for opening and closing the discharge opening; and developing means for developing a latent image formed on an image bearing member by the developer, the developing means having a supply opening connected to the discharge opening, in which the unit has a groove through which a moving body for moving the shutter passes, and a brush member is attached to the groove.

Still another object of the present invention is to provide an image forming apparatus, comprising: developing means for developing a latent image formed on an image bearing member by a developer, the developing means being detachably attachable to a main assembly of the image forming apparatus; and a supplying container for containing the developer to be supplied to the developing means, the supplying container having a discharge opening for discharging the developer and a shutter for opening and closing the discharge opening, in which the supplying container has a groove through which a moving body for moving the shutter passes and a brush member is attached to the groove.

Still another object of the present invention is to provide a unit detachably attachable to an image forming apparatus, comprising: a groove through which a part of a moving body that is movable relative to the unit passed; and a brush member attached to the groove, in which, when the moving body passes through the groove, the moving body contacts the brush member.

These and other objects and advantages of the invention may be readily ascertained by referring to the following description and accompanying drawings.

DETAILED DESCRIPTION OF THE PREFERRED EMBODIMENTS

Embodiments of the present invention will be hereinafter described in detail with reference to the accompanying drawings.

Note that, in the following description, a longitudinal direction means a direction identical with an axial direction of an electrophotographic photosensitive drum (hereinafter referred to as a photosensitive drum). In addition, on the basis of a direction of inserting a cartridge in an electrophotographic image forming apparatus, an inserting direction is referred to as an inner side and a pulling-out direction is referred to as a front side. Moreover, the term "up and down" means up and down in a mounted state of the cartridge.

(Description of an Entire Image Forming Apparatus)

Figure 1:
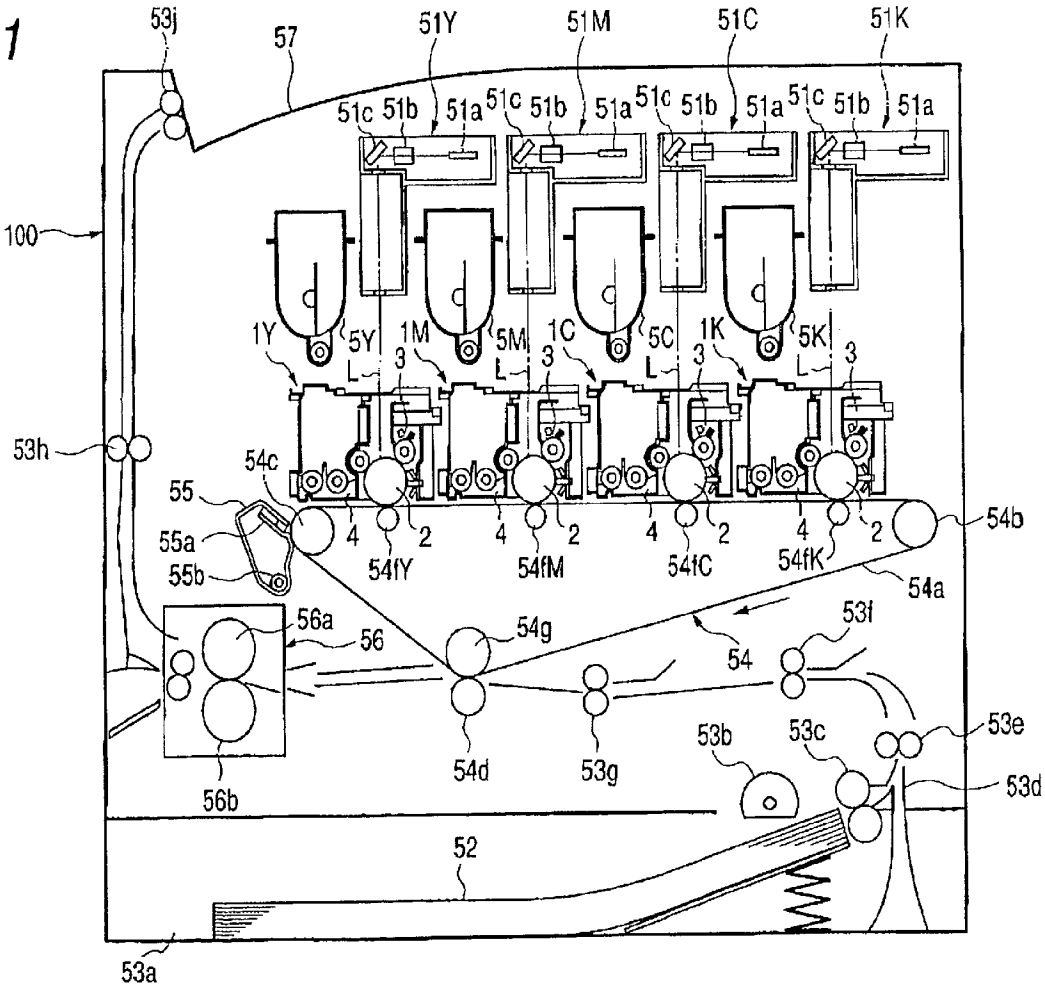
FIG. 1 shows a longitudinal section of an image forming apparatus (color laser beam printer) in accordance with the present invention.
Figure 2:
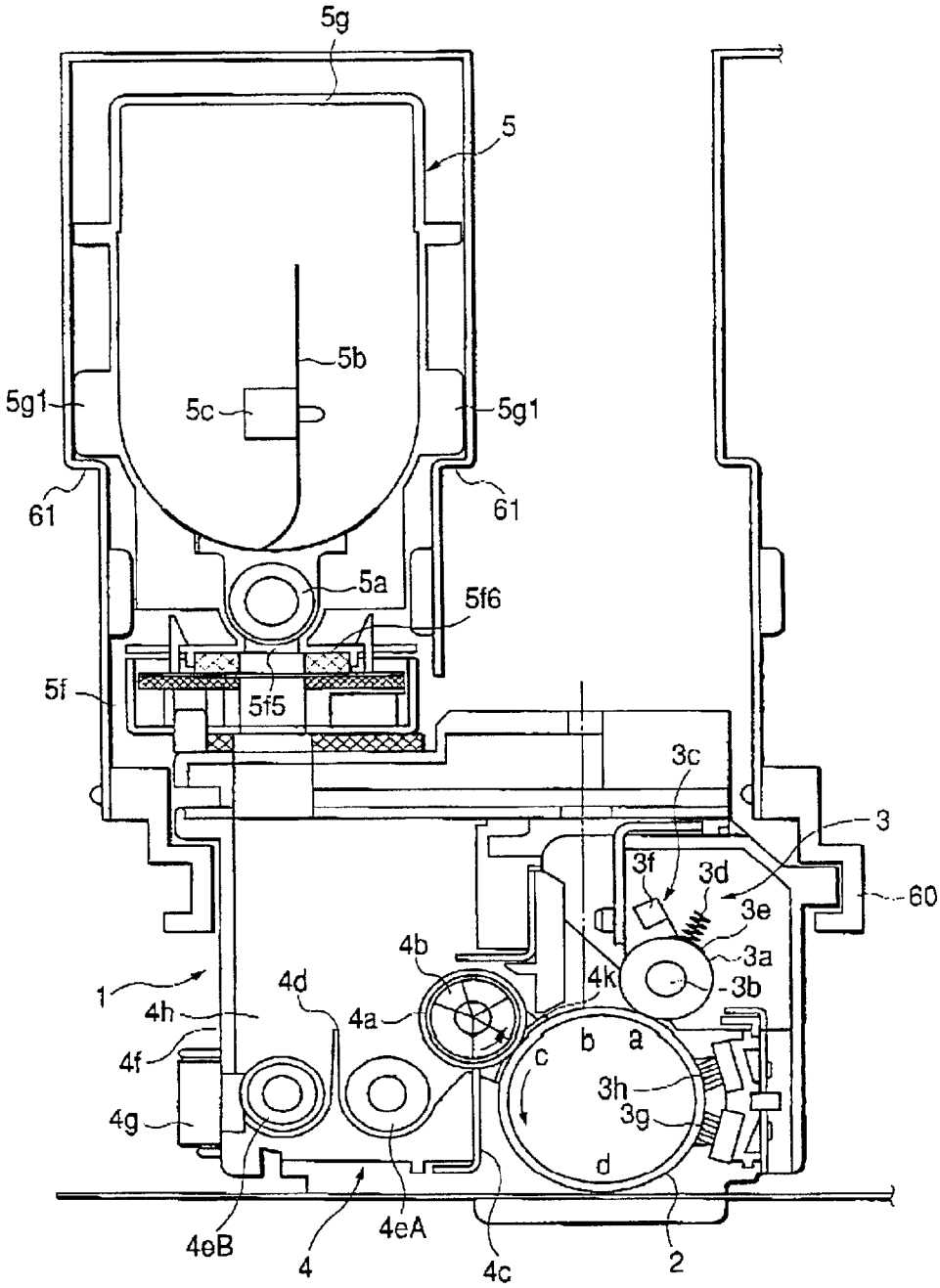
FIG. 2 shows a longitudinal section of a process cartridge and a toner supplying container in accordance with the present invention.
Figure 3:
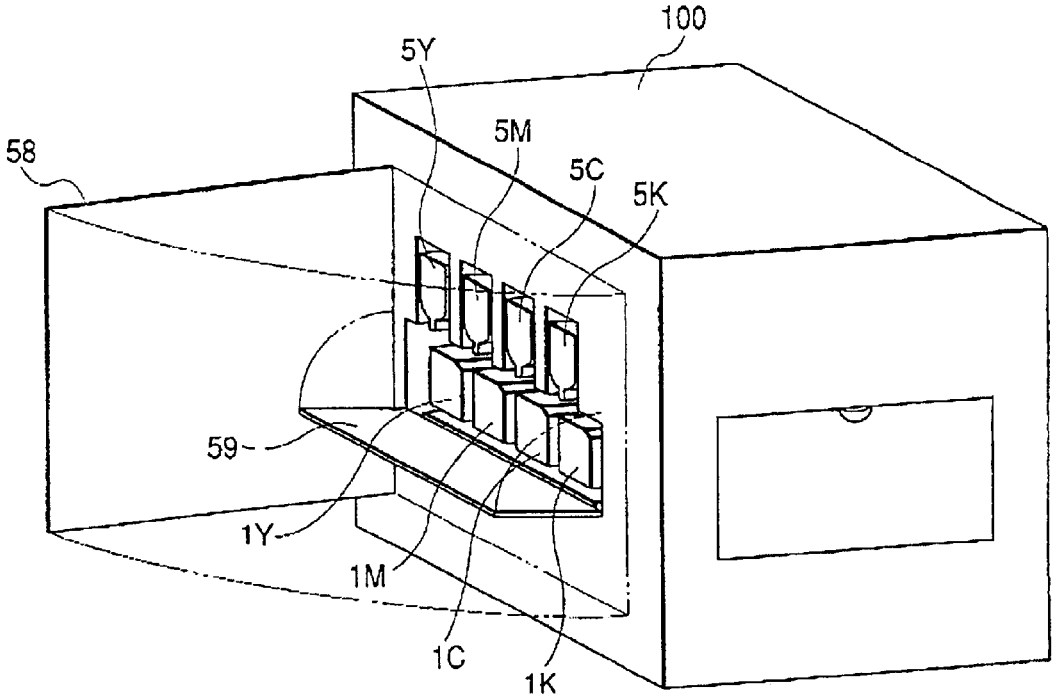
FIG. 3 is a perspective view showing a state in which a front door of the image forming apparatus (color laser beam printer) in accordance with the present invention is open.
Figure 4:
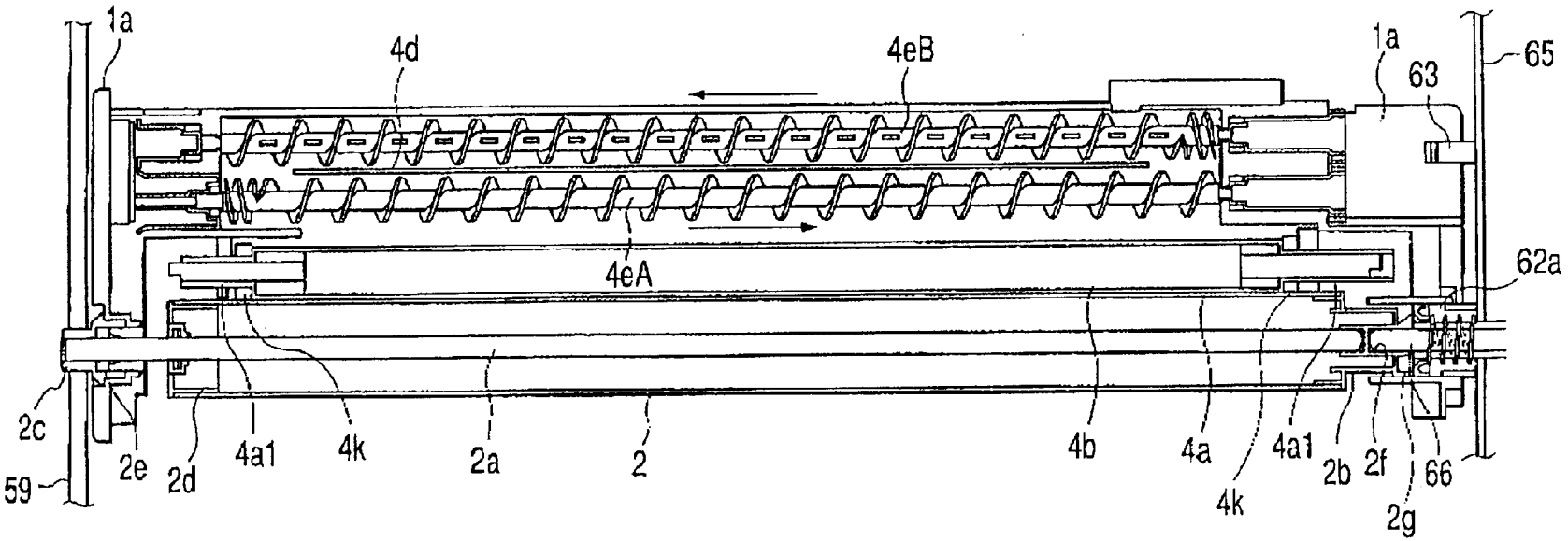
FIG. 4 shows a cross section in the longitudinal direction of the process cartridge.
Figure 5:
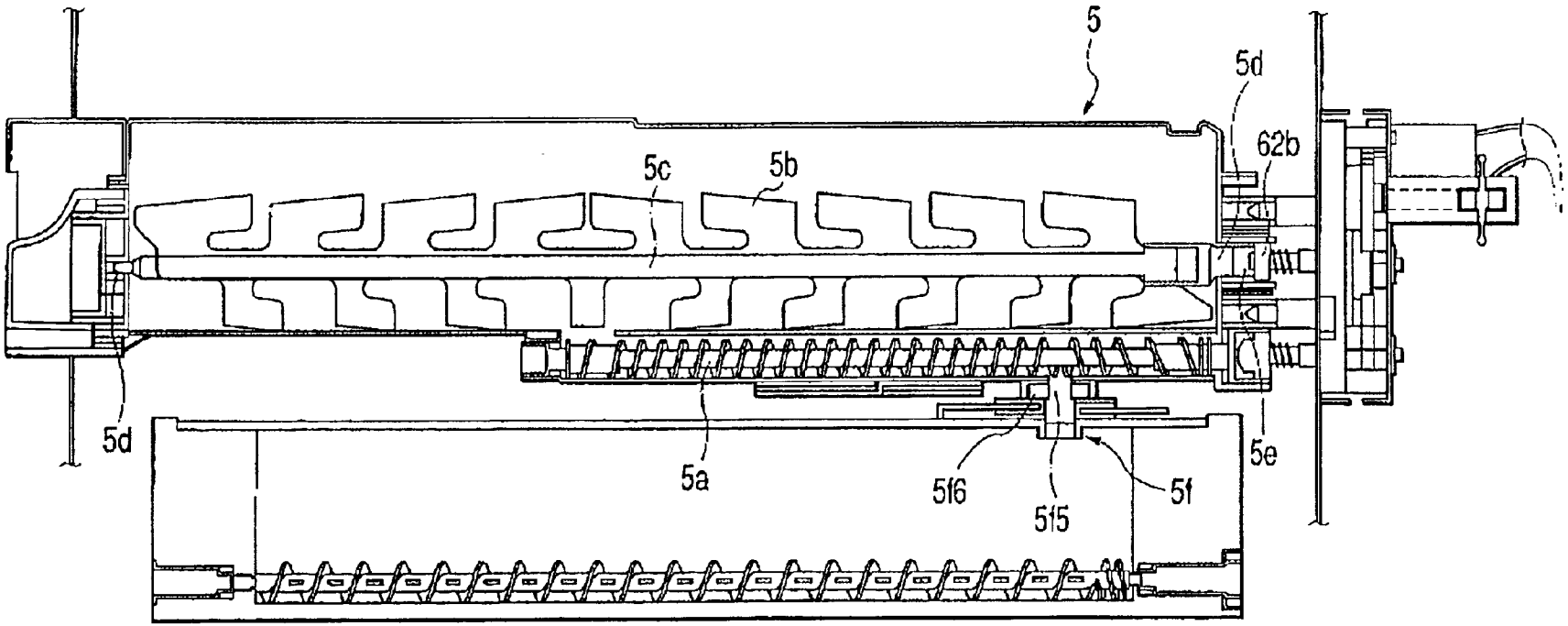
FIG. 5 shows a longitudinal section in the longitudinal direction of the toner supplying container and the process cartridge in accordance with the present invention.

FIG. 1 is a sectional view showing an entire configuration of a color laser beam printer as one form of a color image forming apparatus. FIG. 2 is a sectional view of a process cartridge and a toner supplying container in accordance with the present invention. FIG. 3 is a perspective view of the image forming apparatus. FIG. 4 is a planar sectional view in the longitudinal direction of the process cartridge. FIG. 5 is a sectional view of the toner supplying container.

First, the entire configuration of the color laser beam printer will be described with reference to FIG. 1.

An image forming unit of the color laser beam printer shown in FIG. 1 is provided with four process cartridges 1Y (yellow), 1M (magenta), 1C (cyan) and 1K (black) including photosensitive drums 2 functioning as image bearing members and exposing means (laser beam optical scanning systems) 51Y, 51M, 51C and 51K arranged parallel with each other corresponding to each color above the process cartridges 1 (1Y, 1M, 1C and 1K).

In addition, below the image forming unit, there are disposed feeding means for feeding recording media 52, an intermediate transferring belt 54*a* for transferring a toner image formed on the photosensitive drum 2, a secondary transfer roller 54*d* for transferring the toner image on the intermediate transferring belt 54*a* to the recording media 52, a fixing device 56 for fixing the toner image transferred to the recording media 52 and discharge rollers 53*h* and 53*j* for, discharging the recording media 52 to the outside and stacking them.

Here, as the recording medium 52, for example, a sheet, an OHP sheet and a cloth are used.

Note that, the color laser beam printer in accordance with this embodiment is an apparatus employing a cleaner-less system, in which transfer residual toner remaining on the photosensitive drums 2 is collected in developing apparatuses and dedicated cleaners for collecting and storing the transfer residual toner are not disposed in the process cartridges 1 (1Y, 1M, 1C and 1K).

Next, a structure of the above-mentioned each unit will be described in detail one by one.

(Feeding Means)

The feeding means is for feeding the recording media 52 to the image forming unit and is mainly constituted by a feeding cassette 53*a* in which a plurality of recording media 52 are stacked and contained, a feeding roller 53*b*, a retard roller pair 53*c* for preventing double feed, a feeding guide 53*d* and a registration roller pair 53*g*.

The feeding roller 53*b* is rotated according to an image forming operation and separates to feed the recording media 52 in the feeding cassette 53*a* one by one. The recording media 52 are prevented from being fed doubly by the retard roller pair 53*c* and are guided by the feeding guide 53*d* to be conveyed to the registration roller pair 53*g* via conveying roller pairs 53*e* and 53*f*.

The registration roller pair 53*g* performs a non-rotating operation for causing the recording medium 52 to be stationary in a standby state during an image forming operation and a rotating operation for conveying the recording medium 52 toward the intermediate transferring belt 54*a* in a predetermined sequence. In this way, the registration roller pair 53*g* performs positioning of a toner image and the recording medium 52 at the time of a transfer step that is the next step.

Immediately after the recording medium 52 is conveyed, the registration roller pair 53*g* stops rotation and the recording medium 52 abuts a nip portion of the registration roller pair 53*g*, whereby skew feeding is corrected.

(Process Cartridge)

The process cartridges 1 (1Y, 1M, 1C and 1K) are integrally constituted with charging devices 3 and developing apparatuses 4 disposed around the photosensitive drums 2 functioning as image bearing members. These process cartridges 1 (Y, 1M, 1C and 1K) can be easily removed from an apparatus main body 100 by users and are replaced with new ones when the photosensitive drums 2 have exhausted their lives.

In this embodiment, for example, the number of rotations of the photosensitive drums 2 is counted. If the number of rotations exceeds a predetermined count number, it is indicated that the process cartridges 1 (1Y, 1M, 1C and 1K) have reached the end of their lives.

The photosensitive drum 2 in accordance with this embodiment is a negatively charged organic photosensitive body. This is constituted by forming a photosensitive layer usually used on a hollow cylindrical drum base body of aluminum with a diameter of approximately 30 mm. A charge injecting layer is provided in an uppermost surface layer. In addition, this photosensitive drum 2 is rotated at a predetermined process speed (in this embodiment, approximately 117 mm/sec). Further, as the charge injecting layer, a coated layer of a material made of binder of insulating resin scattered with, for example, $SnO_2$ ultra-fine particles as conductive fine particles, is used.

As shown in FIG. 4, a drum flange 2*b* is fixed into an inner side end portion in a longitudinal direction of a drum base body of the photosensitive drum 2 (right end portion in FIG. 4) and a driven flange 2*d* is fixed into the front end portion (left end portion in FIG. 4). A drum shaft 2*a* pierces the centers of the drum flange 2*b* and the driven flange 2*d*. The drum shaft 2*a* and the driven flange 2*d* engage with each other to integrally rotate. Then, the drum base body, the drum shaft 2*a*, the drum flange 2*b* and the driven flange 2*d* are rotated integrally. That is, the photosensitive drum 2 is rotated around the axis of the drum shaft 2*a*.

In addition, the front side end portion of the drum shaft 2*a* is rotatably supported by a bearing 2*e*, which is fixed to a bearing case 2*c*. Further, the bearing case 2*c* is fixed to a frame 1*a* of the process cartridge 1 (1Y, 1M, 1C or 1K).

(Charging Means)

The charging device 3 as charging means uses a contact charging system. As shown in FIG. 2, a charging roller 3*a* is used as charging member in this embodiment. This charging roller 3*a* is rotatably held by bearing members (not shown) at both ends of a core metal 3*b* and, at the same time, biased in the direction of the photosensitive drum 2 by a compressing coil spring 3*d*. Thus, it is in press contact with the surface of the photosensitive drum 2 with a predetermined pressing force, thereby rotating in accordance with the rotation of the photosensitive drum 2.

Reference symbol 3*c* denotes a charging roller cleaning member, which is constituted by attaching a flexible cleaning film 3*e* to a supporting member 3*f* in this embodiment. Here, the cleaning film 3*e* is disposed i parallel to the charging roller 3*a* in its longitudinal direction. One end of the cleaning film 3*e* is fixed to the supporting member 3*f* that performs reciprocation of a fixed amount with respect to the longitudinal direction. The surface of the cleaning film 3*e* in the vicinity of its free end side forms a contact nip with the charging roller 3*a*. In addition, the supporting member 3*f* is reciprocally driven by a fixed amount in the longitudinal direction by driving means (not shown) and the surface of the charging roller 3*a* is rubbed by the cleaning film 3*e*. Consequently, deposits, such as fine powder toner and an externally added agent on the surface of the charging roller 3*a*, are removed.

Note that, the color laser beam printer in accordance with this embodiment employs a cleaner-less system described below.

(Cleaner-Less System)

A cleaner-less system employed in this embodiment is for carrying transfer residual toner on the photosensitive drum 2 after transfer to a developing portion c through a charging portion a and an exposing portion b following the subsequent rotation of the photosensitive drum 2, thereby carrying out cleaning simultaneous with development of the transfer residual toner (collecting the transfer residual toner) by a developing apparatus 4.

Since the transfer residual toner on the surface of the photosensitive drum 2 is carried through the exposing portion b, an exposing process is performed onto the transfer residual toner. However, since the amount of the transfer residual toner is small, the exposing process is not significantly affected. Nevertheless, it is likely that toner of a normal polarity, toner of a reverse polarity (reversed toner) and toner with a little charge amount are mixed in the transfer residual toner and the reversed toner or the toner with a little charge amount deposits on the charging roller 3*a* when it passes through the charging portion a, whereby the charging roller 3*a* is contaminated by the toner in excess of an allowable or higher level and a charging defect is caused.

In addition, in order to effectively carry out the cleaning simultaneous with development of the transfer residual toner on the surface of the photosensitive drum 2 by the developing apparatus 4, it is required that the charging polarity of the transfer residual toner on the photosensitive drum 2 to be carried to the developing portion c is normal and the charge amount of the transfer residual toner is at a level for allowing the developing apparatus 4 to develop an electrostatic latent image of the photosensitive drum 2. The reversed toner or toner with an inappropriate charge amount cannot be removed and collected in the developing apparatus 4 from the surface of the photosensitive drum 2 and becomes a cause of a defective image.

In addition, with diversification of users demand in recent years, a large amount of transfer residual toner is generated by continuous print operations and the like of images of a high printing ratio such as a photograph image, which worsens the above-mentioned problem.

Thus, in this embodiment, transfer residual toner (residual developer image) equalizing means 3*g* for equalizing transfer residual toner on the photosensitive drum 2 is provided in a position on the more downstream side in the rotating direction of the photosensitive drum 2 than a transfer portion d. In addition, toner (developer) charging controlling means 3*h* for making the charging polarity of the transfer residual toner to be uniformly negative, that is a normal polarity, is provided in a position on the more downstream side in the rotating direction of the photosensitive drum 2 than the transfer residual toner equalizing means 3*g* and on the more upstream side in the rotating direction of the photosensitive drum 2 than the charging portion a.

Since the transfer residual toner equalizing means 3*g* is provided, even if there is a large amount of pattern-like transfer residual toner on the photosensitive drum 2 carried from the transfer portion d to the toner charging controlling means 3*h*, the transfer residual toner is scattered and distributed on the surface of the photosensitive drum 2 to be made non-patterned. Thus, toner does not concentrate on a part of the toner charging controlling means 3*h* and overall normal polarity charging processing of the transfer residual toner by the toner charging controlling means 3*h* is always performed sufficiently, whereby deposition of the transfer residual toner on the charging roller 3*a* is effectively prevented and the occurrence of a ghost image of a transfer residual toner image pattern is also prevented.

In this embodiment, the transfer residual toner equalizing means 3*g* and the toner charging controlling means 3*h* are formed of a brush-like member having an appropriate conductivity and are disposed with the brush part contacting the surface of the photosensitive drum 2.

In addition, the transfer residual toner equalizing means 3*g* and the toner charging controlling means 3*h* are configured to move (reciprocate) along the longitudinal direction of the photosensitive drum 2 by a driving source (not shown). In this way, the transfer residual toner equalizing means 3*g* and the toner charging controlling means 3*h* do not stay at the same position on the photosensitive drum 2. For example, even if there is an excessively charged part or an insufficiently charged part due to resistance unevenness of the toner charging controlling means 3*h*, since these do not always occur in the same part of the surface of the photosensitive drum 2, the occurrence of fusing on the photosensitive drum 2 by locally excessive charging of the transfer residual toner or deposition of the transfer residual toner on the charging roller 3*a* due to insufficient charging is prevented or eased.

(Exposing Means)

In this embodiment, exposure of the photosensitive drum 2 is performed using laser exposing means 51Y, 51M, 51C and 51K. That is, when an image signal is sent from the apparatus main body 100, a uniformly charged surface of the photosensitive drum 2 is scanned and exposed by a laser beam L that is modulated in response to this signal. Then, an electrostatic latent image corresponding to image information is selectively formed on the surface of the photosensitive drum 2.

As shown in FIG. 1, the laser exposing means 51Y, 51M, 51C and 51K are constituted by solid laser elements (not shown), polygon mirrors 51*a*, focusing lenses 51*b*, reflective mirrors 51*c* and the like. The solid laser elements are turned on/off to be controlled to emit light at a predetermined timing by a light emission signal generator (not shown) based on an inputted image signal. Laser beams L emitted from the solid laser elements are converted into substantially parallel luminous fluxes by a collimator lens system (not shown). The luminous fluxes are scanned by the polygon mirror 51*a* rotating at a high speed and are focused on the photosensitive drum 2 in spots via the focusing lens 51*b* and the reflective mirror 51*c*.

In this way, exposure in a main scanning direction by the laser beam scanning and exposure in a sub-scanning direction by the rotation of the photosensitive drum 2 are applied to the surface of the photosensitive drum 2, whereby an exposure distribution according to an image signal is obtained. That is, a light portion potential part in which a surface potential is reduced and a dark position potential part in which surface potential is not reduced are formed on each photosensitive drum 2 according to irradiation and non-irradiation of the laser beam L. An electrostatic latent image corresponding to image information is formed on each photosensitive drum 2 according to the contrast between the light portion potential part and the dark portion potential part.

(Developing Means)

The developing apparatus 4 functioning as developing means is a two-component contact developing apparatus (two-component magnetic brush developing device). As shown in FIG. 2, the developing apparatus 4 holds a developer consisting of carrier and toner on a developing sleeve 4*a* functioning as a developer bearing member containing a magnet roller 4*b*. The developing sleeve 4*a* is provided with a regulating blade 4*c* at a predetermined interval. A thin layer of the developer is formed on the developing sleeve 4*a* following the rotation of the developing sleeve 4*a* in the direction indicated by the arrow inside developing sleeve 4*a*. Further, although the two-component magnetic brush developing apparatus is used as the developing apparatus 4 in this embodiment, the developing apparatus is not limited to this.

As shown in FIG. 4, the developing sleeve 4*a* is disposed such that by rotatably fitting a roller-like spacer 4*k* into contracted-diameter journal portions 4*a*1 on both sides thereof, a predetermined gap is formed between the photosensitive drum 2 and the developing sleeve 4*a*. The developing sleeve 4*a* is set such that, in development, a development operation can be performed with the developer formed thereon contacting the photosensitive drum 2. In addition, as shown in FIG. 2, the developing sleeve 4*a* is rotated in a direction illustrated by an arrow (counterclockwise direction) at a predetermined peripheral speed such that its circumferential surface moves in a counter direction with respect to a moving direction of the circumferential surface of the photosensitive drum 2 at a developing portion.

In this embodiment, negatively charged toner with an average particle diameter of 6 $\mu$m is used as the toner and a magnetic carrier with an average particle diameter of 35 $\mu$m and a saturation magnetization of 205 emu/cm$^3$ is used as the magnetic carrier. In addition, a mixture of toner and carrier at a weight ratio of 6:94 is used as the developer. Further, the developer is not limited to the mixture of toner and magnetic carrier and magnetic toner can be used as the developer.

As shown in FIG. 2, a developer containing portion 4*h*, in which the developer is circulating, is partitioned into two parts by a partition wall 4*d* provided over its longitudinal direction excluding both of its end parts. Agitating screws 4*e*A and 4*e*B are disposed on both of its sides across the partition wall 4*d*.

As shown in FIG. 4, toner supplied from toner supplying containers 5 (5Y, 5M, 5C and 5K) falls into the inner side of the agitating screw 4*e*B (the right side in FIG. 4) and is agitated while being fed to the front side in the longitudinal direction (the left side in FIG. 4) to pass a part at the end on the front side where the partition wall 4*d* does not exist. Then, the toner is fed to the much inner side in the longitudinal direction (the right side in FIG. 4) by the agitating screw 4*e*A to pass through a part on the inner side where the partition wall 4*d* does not exist and is agitated again by the agitating screw 4*e*B while being fed by it to repeat circulation.

Here, a developing process for visualizing an electrostatic latent image formed on the photosensitive drum 2 by a two-component magnetic brush method using the developing apparatus 4 and a circulation system of a developer will be described with reference to FIG. 2.

According to a rotation of the developing sleeve 4*a*, the developer in the developer containing portion 4*h* is drawn up to the surface of the developing sleeve 4*a* at a draw-up pole of the magnetic roller 4*b* and conveyed. In the course of the developer being conveyed, the layer thickness of the developer is regulated by the regulating blade 4*c* that is disposed vertically with respect to the developing sleeve 4*a* and a thin layer of developer is formed on the developing sleeve 4*a*. Then, when the thin layered developer is conveyed to a developing pole corresponding to the developing portion c, a magnetic brush of the developer is formed by a magnetic force. The electrostatic latent image on the surface of the photosensitive drum 2 is developed as a toner image by toner in the developer standing like the ears of rice. Further, the electrostatic latent image is subjected to reversal development in this embodiment.

The thin-layered developer on the developing sleeve 4*a*, which has passed through the developing portion, subsequently enters the developer containing portion 4*h* following the rotation of the developing sleeve 4*a* and removes from the developing sleeve 4*a* by a repulsive magnetic field of the conveying pole to be returned to the developer containing portion 4*h*.

A direct current (DC) voltage and an alternating current (AC) voltage are applied to the developing sleeve 4*a* from power sources (not shown). In this embodiment, a direct current voltage of −500 V and an alternating current voltage with a peak-to-peak voltage of 1500 V at a frequency of 2000 Hz are applied to the developing sleeve 4*a*, whereby only an exposed portion of the photosensitive drum 2 is selectively developed.

In general, in the two-component development method, when an alternating current voltage is applied, the developing efficiency is increased to make a high-grade image. However, on the other hand, a deficiency occurs in that a fogged image tends to be generated. Thus, usually, a fogged image is prevented by providing a potential difference between the direct current voltage applied to the developing sleeve 4*a* and the surface potential of the photosensitive drum 2. More specifically, a bias voltage of the potential difference between the potential of an exposed portion and the potential of an unexposed portion of the photosensitive drum 2 is applied.

Therefore, when the toner is consumed by development, the toner density in the developer decreases. In this embodiment, a sensor 4*g* (see FIG. 2) for sensing the toner density is disposed in a position close to the external circumferential surface of the agitating screw 4*e*B as shown in FIG. 2. When the sensor 4*g* senses that the toner density in the developer has decreased to be lower than a predetermined density level, an instruction to supply toner in the developer containing portion 4*h* of the developing apparatus 4 is outputted from each of the toner supplying containers 5 (5Y, 5M, 5C and 5K). The toner density of the developer is always maintained at a predetermined level by this toner supply operation.

(Toner Supplying Container)

The toner supplying containers (units) 5 (5Y, 5M, 5C and 5K) are disposed parallel with each other above the process cartridges 1 (1Y, 1M, 1C and 1K), respectively, and are mounted in the apparatus main body 100 from its front.

As shown in FIG. 2, in each of the toner supplying containers 5 (5Y, 5M, 5C and 5K), toner or a mixture of toner and magnetic carrier is contained inside a frame body 5*g* functioning as a toner containing portion (developer containing portion), an agitating plate 5*b* fixed to an agitating shaft 5*c* and a screw 5*a* are disposed and a discharge opening portion 5*f* for discharging toner is formed on the bottom surface of the container. As shown in FIG. 5, the screw 5*a* and the agitating shaft 5*c* are rotatably supported by bearings 5*d* at both their ends and a driving coupling (concave) 5*e* is disposed in the endmost part on the inner side (the right side in FIG. 5). This driving coupling (concave) 5*e* receives the transmission of a driving force from a driving coupling (convex) 62*b* of the apparatus main body 100 and is rotated.

An external portion of the screw 5*a* is formed in a spiral rib shape and a twisting direction of the spiral is reversed around the discharge opening portion 5*f*. Then, the screw 5*a* is rotated in a predetermined rotating direction by the rotation of the driving coupling (convex) 62*b*, whereby the toner is conveyed to the discharge opening portion 5*f*. The toner is caused to free-fall by the discharge opening portion 5*f* to be supplied to each of the process cartridges 1 (1Y, 1M, 1C and 1K).

A tip portion in the rotational radial direction of the agitating plate 5*b* is inclined and, when it rubs the wall surface of each of the toner supplying containers 5 (5Y, 5M, 5C and 5K), the tip end portion of the agitating plate 5*b* is abutted to the wall surface with a certain angle. More specifically, the tip side of the agitating plate 5*b* is twisted to be in a spiral state. As the tip side of the agitating plate 5*b* is twisted and inclined in this way, a conveying force in the axial direction is generated to feed the toner in the longitudinal direction.

Further, the toner supplying containers 5 (5Y, 5M, 5C and 5K) in accordance with this embodiment are not limited to be used according to the two-component development method and can supply toner in a process cartridge or a development cartridge using a one-component development method. In addition, powder to be contained in the toner supplying containers 5 (5Y, 5M, 5C and 5K) is not limited to toner and may be a developer that is a mixture of toner and magnetic carrier.

(Transferring Means)

An intermediate transferring unit 54 functioning as transferring means shown in FIG. 1 is for secondarily transferring a plurality of toner images onto a recording medium 54, which are primarily transferred from the photosensitive drums 2 and superposed one after another, collectively.

As shown in FIG. 1, the intermediate transferring unit 54 is provided with the intermediate transferring belt 54*a* running in the direction of an illustrated arrow. The intermediate transferring belt 54*a* runs in the illustrated arrow direction (clockwise direction) at a peripheral speed which is substantially the same as the external peripheral speed of the photosensitive drums 2. The intermediate transferring belt 54*a* is an endless belt with a circumferential length of approximately 940 mm and is laid over three rollers, namely, the driving roller 54*b*, a secondary transfer opposing roller 54*g* and a driven roller 54*c*.

In addition, transfer charging rollers 54*f*Y, 54*f*M, 54*f*C and 54*f*K are rotatably disposed in positions opposing the photosensitive drums 2, respectively, inside the intermediate transferring belt 54*a* and are pressured in the direction to the centers of the photosensitive drums 2.

The transfer charging rollers 54*f*Y, 54*f*M, 54*f*C and 54*f*K are supplied with power from a high voltage power source (not shown) and perform charging of a polarity opposite that of the toner from the back side of the intermediate transferring belt 54*a*, thereby primarily transferring toner images on the photosensitive drums 2 to the upper surface of the intermediate transferring belt 54*a* one after another.

In a secondary transfer portion, the secondary transfer roller 54*d* as a transferring member is in press contact with the intermediate transferring belt 54*a* in a position opposing the secondary transfer opposing roller 54*g*. The secondary transfer roller 54*d* is swingable in the vertical direction of FIG. 1 and rotates. Then, the secondary transfer roller 54*d* is away from the intermediate transferring belt 54*a* such that it does not harm an image on the intermediate transferring belt 54*a* until images are sequentially superposed and transferred onto the intermediate transferring belt 54*a* and a multi-color image is completed.

Here, the intermediate transferring belt 54*a* and the secondary transfer roller 54*d* are driven, respectively. When the recording medium 52 rushes in the secondary transfer portion, a predetermined bias is applied to the secondary transfer roller 54 and a toner image on the intermediate transferring belt 54*a* is secondarily transferred to the recording medium 52. At this point, the recording medium 52 nipped between the intermediate transferring belt 54*a* and the secondary transfer roller 54*d* is subjected to a transfer process and, at the same time, conveyed in the left direction in FIG. 1 at a predetermined speed to the fixing device 56 for fixing processing that is the next process.

A cleaning unit 55 capable of contacting and separating with respect to the surface of the intermediate transferring belt 54*a* is provided in a predetermined position of the intermediate transferring belt 54*a* that is the most downstream side in the transfer process. Transfer residual toner remaining after the secondary transfer is removed by the cleaning unit 55.

As shown in FIG. 1, a cleaning blade 55*a* for removing transfer residual toner is disposed in the cleaning unit 55. The cleaning unit 55 is swingably attached at its rotational center (not shown) and the cleaning blade 55*a* is in press contact with the intermediate transferring belt 54*a* in a direction of biting into it. The transfer residual toner collected in the cleaning unit 55 is conveyed to a waste toner tank (not shown) by a feeding screw 55*b* and stored therein.

Here, a belt made of polyimide resin can be used as the intermediate transferring belt 54*a*. The material for the intermediate transferring belt 54*a* is not limited to polyimide resin, and plastic such as polycarbonate resin, polyethylene terephthalate resin, polyvinylidene fluoride resin, polyethylene naphthalate resin, polyether etherketone resin, polyether sulfone resin and polyurethane resin, fluoride-based or silicon-based rubber and the like can be used preferably.

(Fixing Unit)

As described above, the toner image formed on the photosensitive drum 2 by the developing apparatus 4 is transferred onto the recording medium 52 via the intermediate transferring belt 54*a*. Then, the fixing device 56 fixes the toner image transferred to the recording medium 52 thereon using heat.

As shown in FIG. 1, the fixing device 56 is provided with a fixing roller 56*a* for applying heat to the recording medium 52 and a pressure roller 56*b* for bringing the recording medium 52 to be in press contact with the fixing roller 56*a*. The fixing roller 56*a* and the pressure roller 56*b* are constituted by hollow rollers, in which heaters (not shown) are provided, respectively. In addition, the fixing roller 56*a* and the pressure roller 56*b* are rotated, thereby conveying the recording medium 52 simultaneously.

That is, the recording medium 52 holding the toner image is conveyed by the fixing roller 56*a* and the pressure roller 56*b* and heat and pressure are applied thereto, thereby fixing the toner image thereonto. Then, the recording medium 52 after fixing of the toner image is discharged by the discharge rollers 53*h* and 53*j* and stacked in a tray 57 on the apparatus main body 100.

(Mounting of a Process Cartridge and a Toner Supplying Container)

Next, procedures for mounting the process cartridges 1 (1Y, 1M, 1C and 1K) and the toner supplying containers 5 (5Y, 5M, 5C and 5K) in the apparatus main body 100 will be described with reference to FIGS. 2 and 5.

FIG. 3 is a perspective view schematically showing the appearance of the apparatus main body 100. As shown in the figure, a front door 58 capable of opening and closing is disposed in the front surface of the apparatus main body 100. When the front door 58 is pulled to the front side, openings in which the process cartridges 1Y, 1M, 1C and 1K and the toner supplying containers 5Y, 5M, 5C and 5K are inserted are exposed.

A rotatably supported centering plate 59 is disposed in the openings in which the process cartridges 1Y, 1M, 1C and 1K are inserted. The process cartridges 1Y, 1M, 1C and 1K are inserted and pulled out after the centering plate 59 is opened. As shown in FIG. 2, a guide rail 60 for guiding mounting of the process cartridges 1Y, 1M, 1C and 1K and a guide rail 61 for guiding mounting of the toner supplying containers 5Y, 5M, 5C and 5K are provided in the apparatus main body 100.

The direction of mounting the process cartridges 1Y, 1M, 1C and 1K and the toner supplying containers 5Y, 5M, 5C and 5K is parallel with the axial direction of the photosensitive drum 2. The guide rails 60 and 61 are also disposed in the same direction. The process cartridges 1Y, 1M, 1C and 1K and the toner supplying containers 5Y, 5M, 5C and 5K are slid to be inserted from the front side to the inner side in the apparatus main body 100 along the guide rails 60 and 61.

When the process cartridges 1Y, 1M, 1C and 1K are inserted to the innermost part, a centering shaft 66 of the apparatus main body 100 is inserted in a central hole 2*f* of the drum flange 2*b* as shown in FIG. 4 and a rotational central position on the inner side of the photosensitive drum 2 is defined with respect to the apparatus main body 100. In addition, simultaneously with this, a drive transmitting portion 2*g* formed in the drum flange 2*b* and a driving coupling (concave) 62*a* of the apparatus main body 100 are coupled and the photosensitive drum 2 is allowed to be rotated. Further, the drive transmitting portion 2*g* used in this embodiment is formed in a twisted triangular prism shape. As a driving force from the apparatus main body 100 is applied to it, the driving force is transmitted to the photosensitive drum 2 and a force pulling the photosensitive drum 2 to the inner side is generated.

In addition, as shown in FIG. 4, a support pin 63 for positioning the process cartridge 1Y, 1M, 1C or 1K is disposed on a rear side plate 65. As the support pin 63 is inserted in the frame 1*a* of the process cartridge 1Y, 1M, 1C or 1K the position of the frame 1*a* is fixed.

As shown in FIG. 4, the rotatable centering plate 59 is disposed on the front side of the apparatus main body 100 (the left side in FIG. 4). The bearing case 2*c* of the process cartridge 1Y, 1M, 1C or 1K fits in the centering plate 59, whereby the process cartridge 1Y, 1M, 1C or 1K is supported and fixed. According to a set of these inserting operations, the photosensitive drum 2 and the process cartridge 1Y, 1M, 1C or 1K are positioned with respect to the apparatus main body 100.

On the other hand, as shown in FIG. 5, when the toner supplying container 5Y, 5M, 5C or 5K is inserted to the innermost portion in the same manner as the process cartridge 1Y, 1M, 1C or 1K, it is fixed to the support pin 63 protruding from the rear side plate 65. In addition, simultaneous with this, the driving coupling (concave) 5*e* and the driving coupling (convex) 62*b* are coupled to allow the screw 5*a* and the agitating shaft 5*c* to be rotated.

In addition, in order to pull out the process cartridge 1Y, 1M, 1C or 1K or the toner supplying container 5Y, 5M, 5C or 5K from the apparatus main body 100, it is sufficient to carry out the above-mentioned procedures in the reverse order.

Further, in this embodiment, the process cartridges 1Y, 1M, 1C and 1K and the toner supplying containers 5Y, 5M, 5C and 5K can be detachably attachable to the apparatus main body 100 in random order.

That is, the toner supplying containers 5Y, 5M, 5C and 5K may be inserted in the apparatus main body 100 after the process cartridges 1Y, 1M, 1C and 1K are inserted first or the process cartridges 1Y, 1M, 1C and 1K may be inserted in the apparatus main body 100 after the toner supplying containers 5Y, 5M, 5C and 5K are inserted first.

Moreover, the toner supplying containers 5Y, 5M, 5C and 5K may be pulled out from the apparatus main body 100 after the process cartridges 1Y, 1M, 1C and 1K are pulled out first or the process cartridges 1Y, 1M, 1C and 1K may be pulled out from the apparatus main body 100 after the toner supplying containers 5Y, 5M, 5C and 5K are pulled out first.

Next, the gist of the present invention will be described with reference to FIGS. 6 to 15B.

Figure 6:
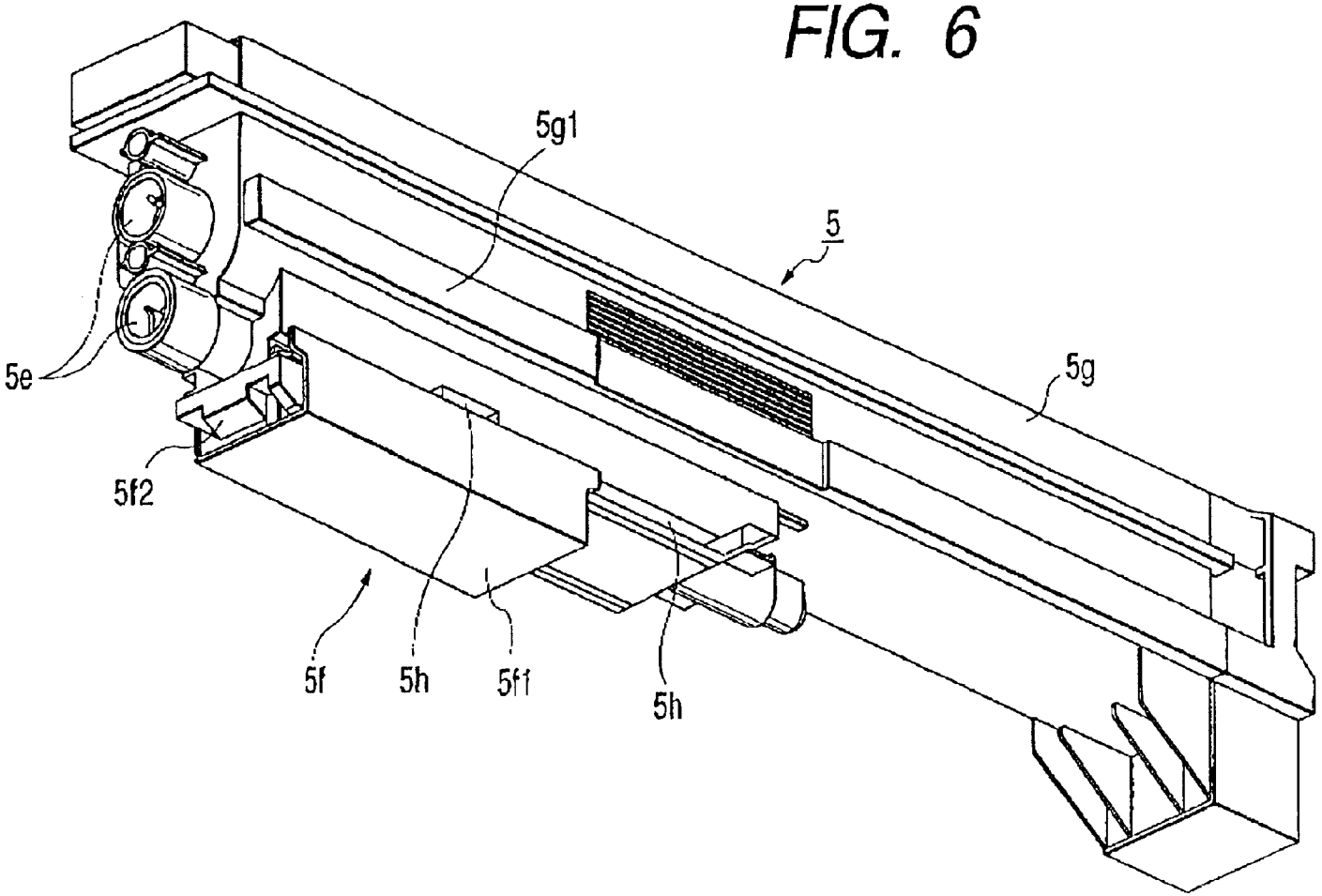
FIG. 6 is a perspective view showing a state in which a discharge opening cover of the toner supplying container in accordance with the present invention is closed.

FIG. 6 is a perspective view of the toner supplying container 5 in accordance with the present invention viewed diagonally from a bottom surface side on its inner side. As shown in the figure, guide portions 5*g*1 (only one of them is shown in FIG. 6), each of which is a guide in inserting the toner supplying container 5 in the apparatus main body 100, are provided on both sides of the frame body 5*g* forming a toner containing portion of the toner supplying container 5. These guide portions 5*g*1 are provided protrudingly to the outside from both sides of the toner supplying container 5 to form a convex shape and are provided linearly over its longitudinal direction. In addition, a lower surface of each guide portion 5*g*1 forms a smooth plane shape and, when the toner supplying container 5 is inserted in the apparatus main body 100, the toner supplying container 5 engages with the apparatus main body 100 and is positioned with the bottom surfaces of the guide portions 5*g*1 mounted on the upper surface of the guide rail 61 provided on the apparatus main body 100 (see FIG. 2).

On the other hand, the discharge opening portion 5*f* for discharging toner to the process cartridge 1 is disposed in the bottom surface of the toner supplying container 5. As shown in the figure, when the toner supplying container 5 is outside the apparatus main body 100, the discharge opening portion 5*f* is covered by a discharge opening cover 5*f*1. The discharge opening cover 5*f*1 is movable along the rail portion 5*h*. When the toner supplying container 5 is inserted in the apparatus main body 100, the end surface in the inserting direction of the discharge opening cover 5*f*1 abuts a (not shown) convex portion provided in the apparatus main body 100, whereby the discharge opening cover 5*f*1 moves along the rail portion 5*h* and the discharge opening portion 5*f* is exposed (see FIG. 10).

In addition, the discharge opening cover 5*f* is energized in the direction of covering the discharge opening portion 5*f* by a (not shown) spring. When the toner supplying container 5 is pulled out of the apparatus main body 100, the discharge opening portion 5*f* is covered by the discharge opening cover 5*f*1 again.

Next, a toner leakage prevention structure of the toner supplying container 5 in accordance with the present invention will be described.

As shown in FIGS. 2 and 5, the discharge opening portion 5*f* for discharging toner into the process cartridge 1 is disposed in a part of the bottom surface of the toner supplying container 5 and a first opening portion 5*f*5 is formed in its central part. In addition, a first seal member 5*f*6 is disposed in the discharge opening portion 5*f* and has a form that surrounds the circumference of the first opening 5*f*5. The first seal member 5*f*6 is adhered to the bottom surface part of the toner supplying container 5. Further, in this embodiment, the discharge opening portion 5*f* is disposed on a drive transmitting side of the screw 5*a* and the inner side in the inserting direction of the toner supplying container 5 (the right side in FIG. 5).

Here, a configuration in the vicinity of the first opening 5*f*5 will be described in detail with reference to FIG. 12. Note that, FIG. 12 is a longitudinal section of the discharge opening portion 5*f* of the toner supplying container 5 viewed from the inserting side of the toner supplying container 5.

Figure 12:
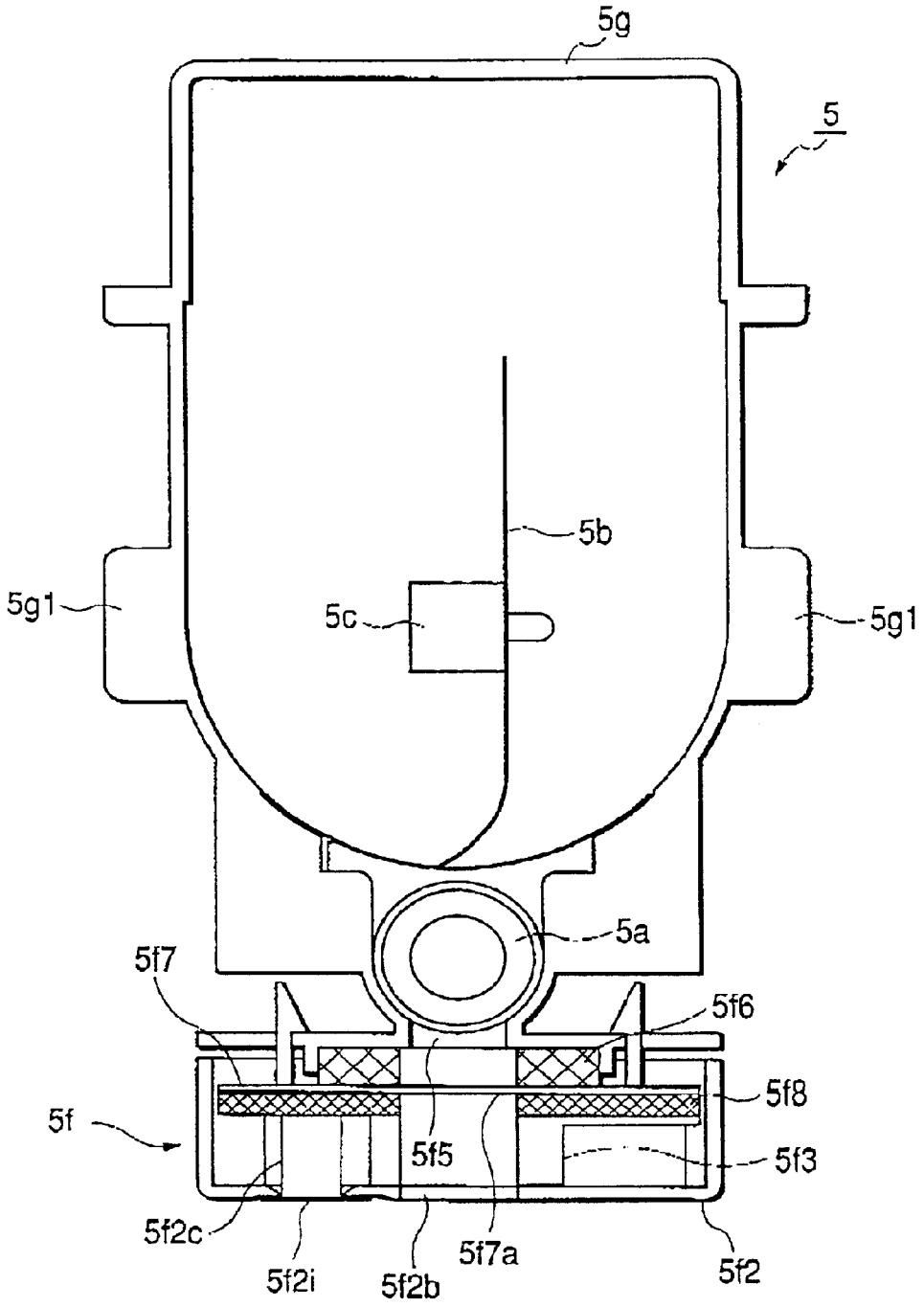
FIG. 12 shows a longitudinal section of the discharge opening portion of the toner supplying container in accordance with the present invention.

As shown in FIG. 12, the first opening 5*f*5 that is a through-hole is formed below the screw 5*a*. The first seal member 5*f*6 is provided below the first opening 5*f*5. The first seal member 5*f*6 is provided for preventing toner from leaking from the circumference of the first opening 5*f*5. The first seal member 5*f*6 is made of an elastic member having a certain degree of thickness in which an opening of the same shape as the first opening 5*f*5 is formed. The first seal member 5*f*6 is supported with its upper surface attached to the bottom surface of the first opening 5*f*5. Further, although urethane foam is used as the first seal member 5*f*6 in this embodiment, the first seal member 5*f*6 is not limited to urethane foam and any other member may be used as long as it has elasticity.

In addition, a seal plate 5*f*7 is provided below the first seal member 5*f*6. Since the seal plate 5*f*7 is supported by the first seal member 5*f*6 with its upper surface attached to the lower surface of the first seal member 5*f*6, the seal plate 5*f*7 can move in vertical and diagonal directions following the elasticity of the first seal member 5*f*6. Further, in the seal plate 5*f*7, a third opening 5*f*7*a*, which is a through-hole is formed in a position corresponding to the first opening 5*f*5 such that toner falls from the first opening 5*f*5 through the opening of the first seal member 5*f*6 and the third opening 5*f*7*a* of the seal plate 5*f*7.

Moreover, a discharge opening shutter 5*f*3 and a pressing member 5*f*2 are disposed in the bottom surface part of the toner supplying container 5. The discharge opening shutter 5*f*3 opens and closes the first opening 5*f*5. The pressing member 5*f*2 is provided with both a function of holding the discharge opening shutter 5*f*3 to be open-closable to prevent it from falling and a function of coupling with a supply opening portion 1*b* (see FIG. 8) of the process cartridge 1.

The discharge opening shutter 5*f*3 is provided below the seal plate 5*f*7 and a second seal member 5*f*8 is sandwiched between the discharge opening shutter 5*f*3 and the seal plate 5*f*7. The second seal member 5*f*8 is for preventing toner from leaking from the circumference of a second opening 5*f*3*b* discussed below that is formed in the discharge opening shutter 5*f*3. The second seal member 5*f*8 is made of an elastic member with an opening provided in a position corresponding to the second opening 5*f*3*b*. Although the second seal member 5*f*8 is fixed with its lower surface attached to the discharge opening shutter 5*f*3, the upper surface of the second seal member 5*f*8 is not fixed to the lower surface of the seal plate 5*f*7 and is slidable. Further, as a material of the second seal member 5*f*8, one with elasticity and a low sliding resistance against the seal plate 5*f*7 is preferable, and urethane foam, urethane foam with a sliding sheet attached to its surface and the like can be used.

Figure 7:
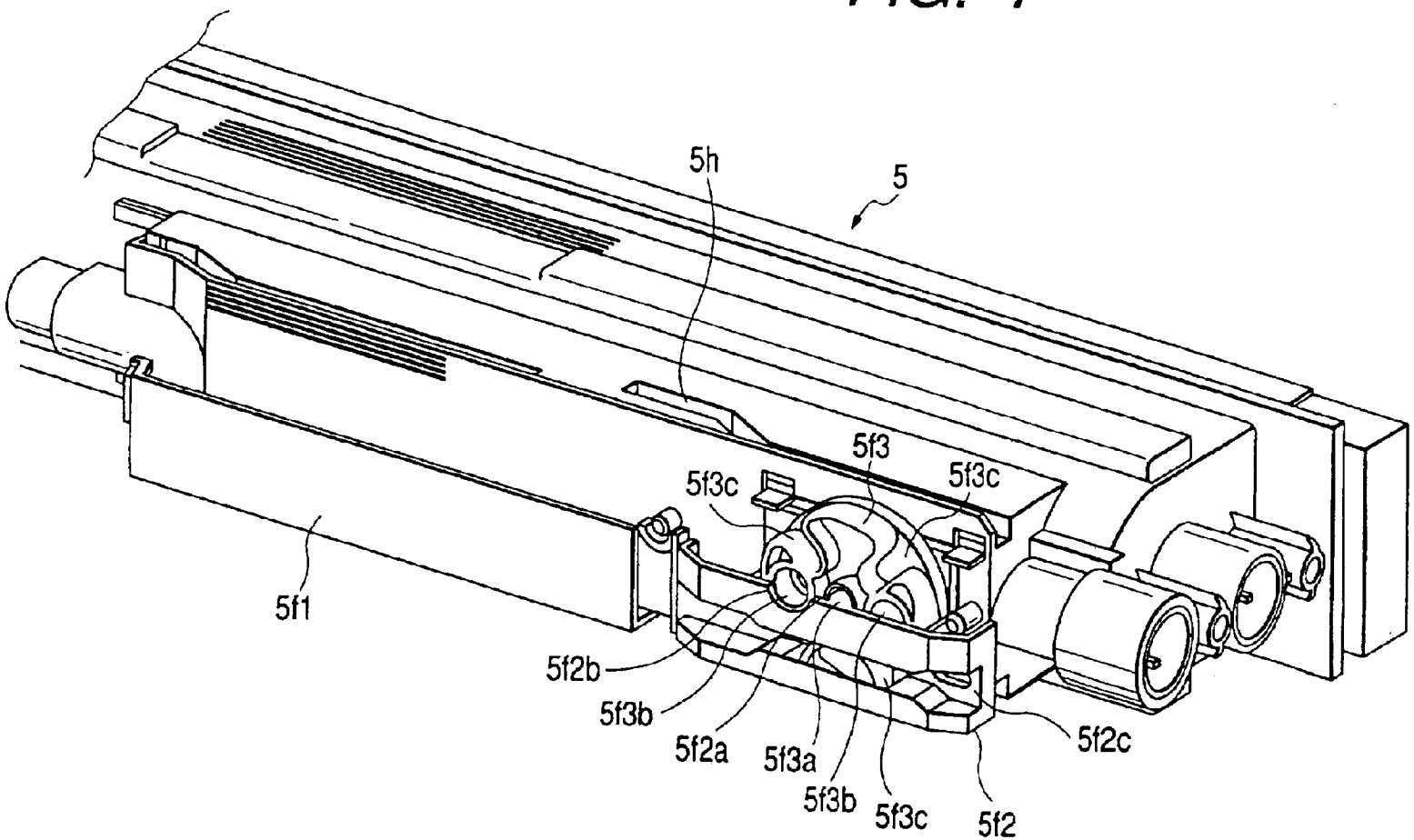
FIG. 7 is a perspective view showing a discharge opening portion of the toner supplying container in accordance with the present invention.

FIG. 7 is a perspective view of the toner supplying container 5 in a state in which the discharge opening cover 5*f*1 and the discharge opening shutter 5*f*3 are opened when viewed from the inner side of its bottom surface. For convenience, the figure shows a state in which a brush curtain 5*f*2*i* discussed below (see FIG. 14) is removed and the discharge opening cover 5*f*1 and the pressing member 5*f*2 are cut substantially in the middle in their longitudinal direction.

As shown in FIG. 7, the discharge opening shutter 5*f*3 has a rotational center 5*f*3*a*. Second openings 5*f*3*b* are disposed in two positions symmetrical with respect to the rotational center 5*f*3*a*. Slits 5*f*3*c* that are engaging portions for rotating the discharge opening shutter 5*f*3 are disposed in four positions 45° out-of-phase with respect to the second openings 5*f*3*b*. The discharge opening shutter 5*f*3 is held by the pressing member 5*f*2 that is a holding member of the discharge opening shutter 5*f*3 and, at the same time, is provided with a function of coupling with the supply opening portion 1*b* of the process cartridge 1.

Figure 9A:
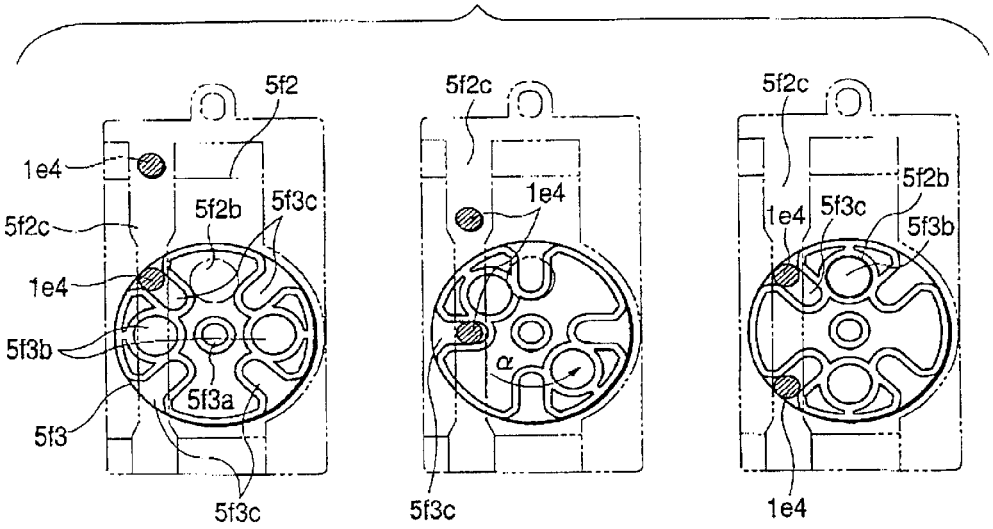
FIG. 9A is a schematic view showing an operation of a discharge opening shutter of the toner supplying container at the time when the process cartridge is being mounted.
Figure 9B:
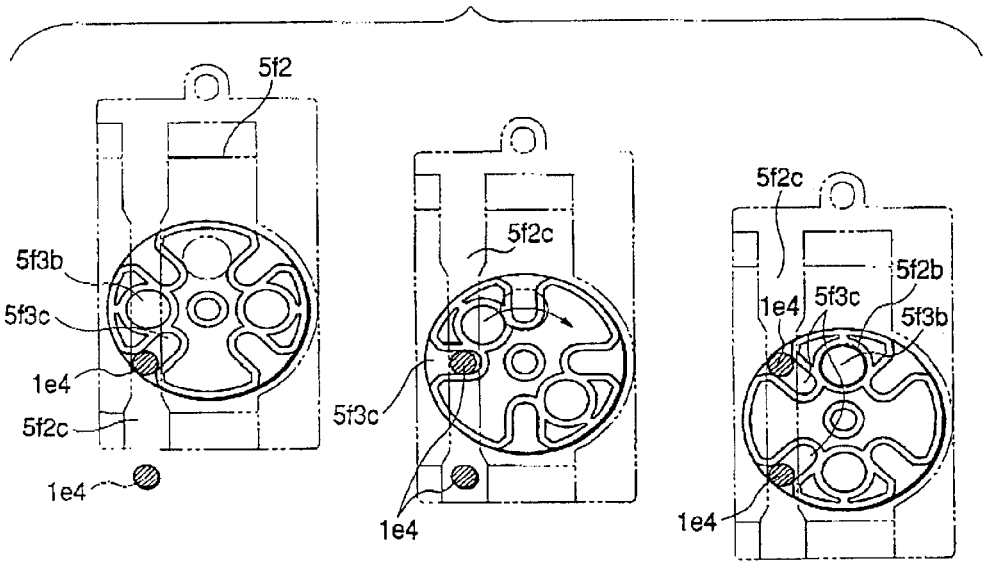
FIG. 9B is a schematic view showing an operation of the discharge opening shutter of the toner supplying container at the time when the toner supplying container is being mounted.
Figure 11A:
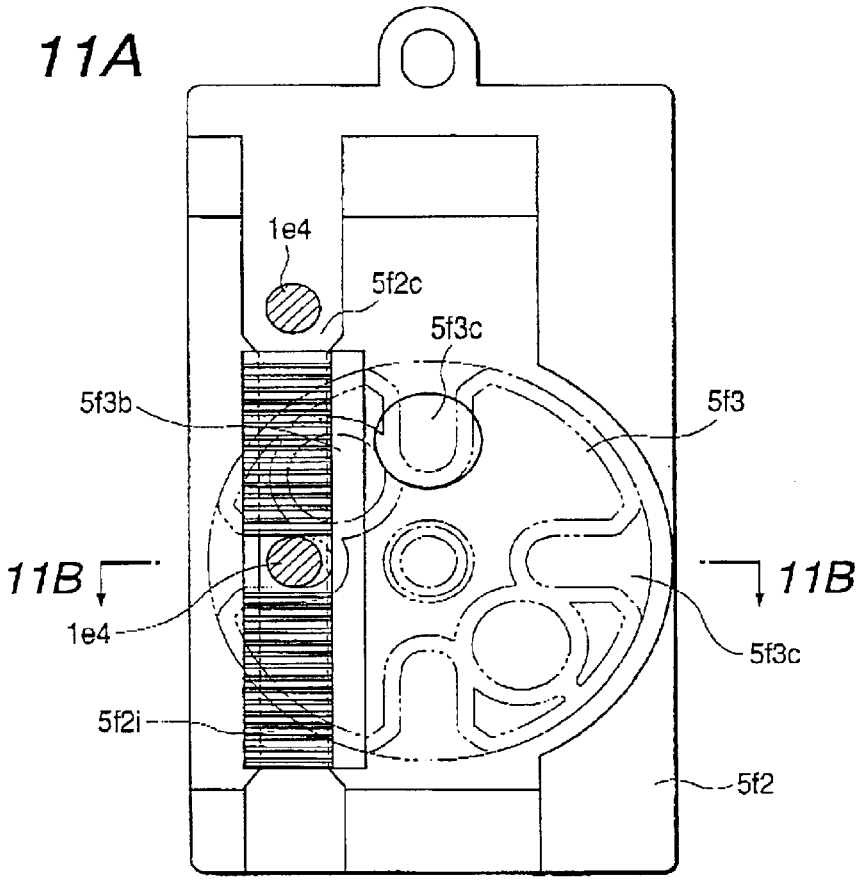
FIG. 11A is a schematic view showing a pressing member, the discharge opening shutter, a brush curtain and a guide pin of the toner supplying container in accordance with the present invention.
Figure 11B:
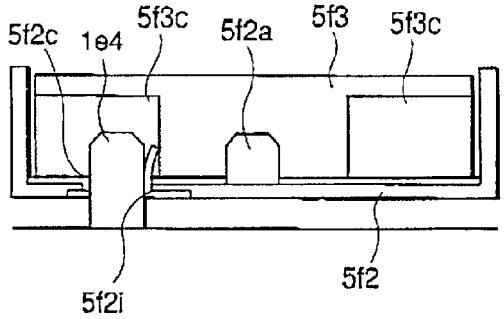
FIG. 11B is a sectional view thereof in an illustrated position of FIG. 11A.

In the pressing member 5*f*2, a pin 5*f*2*a* for rotatably supporting the discharge opening shutter 5*f*3 is provided substantially vertically as shown in FIGS. 11A and 11B and a fourth opening 5*f*2*b* that is a through opening for supplying toner is opened as shown in FIGS. 9A and 9B. In addition, the pressing member 5*f*2 is provided with a slit 5*f*2*c* forming a substantially straight shape in its longitudinal direction.

Figure 8:
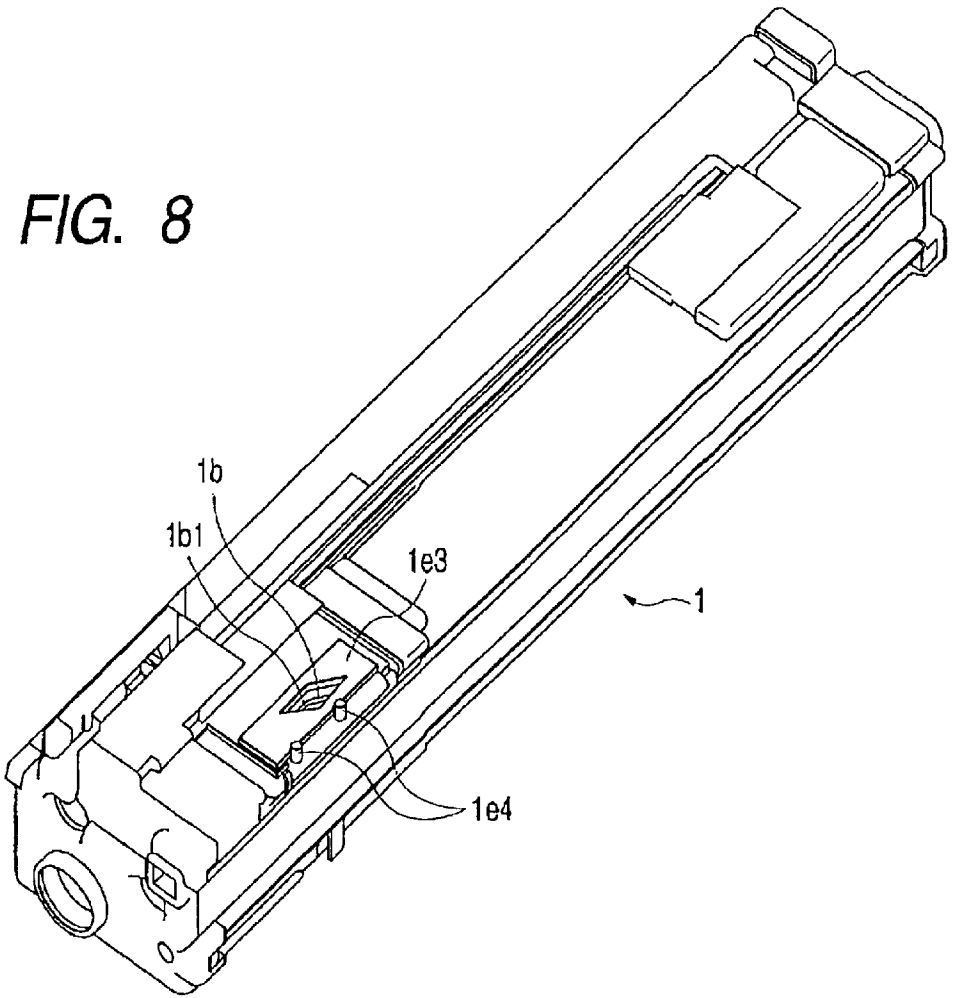
FIG. 8 is a perspective view of a process cartridge.

FIG. 8 is a perspective view of the upper surface part of the process cartridge 1 in accordance with this embodiment. As shown in the figure, a supply opening 1*b*1 is formed in the supply opening portion 1*b* that is a supply portion of toner supplied from the toner supplying container 5. The supply opening 1*b*1 is a through-hole forming a passage through which toner supplied from the toner supplying container 5 falls. A seal member 1*e*3 made of an elastic body having an opening of the same shape as the supply opening 1*b*1 is provided in the supply opening 1*b*1. The seal member 1*e*3 prevents toner from leaking from the circumference of the supply opening 1*b*1.

In addition, two guide pins (moving bodies) 1*e*4 for rotating the discharge opening shutter 5*f*3 provided in the toner supplying container 5 are disposed beside the seal member 1*e*3. The supply opening 1*b*1 is a through-hole of a substantially parallelepiped shape. A pair of opposing sides of the through-hole are arranged in parallel with each other in its longitudinal direction and the seal member 1*e*3 is provided to cover its circumference. The seal member 1*e*3 is for keeping a sealing property when the supply opening 1*b*1 contacts the pressing member 5*f*2 of the toner supplying container 5. The seal member 1*e*3 desirably not only has elasticity but also has high toner removing performance and a low sliding resistance. Further, as the seal member 1*e*3, for example, Teflon felt, Teflon pile, urethane foam or electrostatic flocking can be used.

FIGS. 9A and 9B illustrate operation states of the discharge opening shutter 5*f*3. FIG. 9A illustrates a state transition of operations of the discharge opening shutter 5*f*3 of the toner supplying container 5 at the time when the process cartridge 1 is being inserted. That is, FIG. 9A illustrates a state transition from the left to the right in the figure at the time when the process cartridge 1 is being inserted in the apparatus main body 100 in which the toner supplying container 5 has been mounted in advance. In addition, FIG. 9B illustrates a state transition of operations of the discharge opening shutter 5*f*3 of the toner supplying container 5 at the time when the toner supplying container 5 is being inserted. That is, FIG. 9B illustrates a state transition from the left to the right in the figure at the time when the toner supplying container 5 is being inserted in the apparatus main body 100 in which the process cartridge 1 has been mounted in advance.

As shown in FIG. 9B, if the process cartridge 1 has been mounted in the apparatus main body 100 already, the guide pins 1*e*4 are made immobile (there is no change in their positions). When the toner supplying container 5 is inserted, the guide pin 1*e*4 on the front side formed in the process cartridge 1 is guided by the slit 5*f*2*c* opened in the pressing member 5*f*2 to engage the slit 5*f*3*c* provided in the discharge opening shutter 5*f*3 (the left in FIG. 9B). Since the second opening 5*f*3*b* generates a 90° phase with respect to the first opening 5*f*5 in this state, the first opening 5*f*5 maintains a state in which it is closed by the discharge opening shutter 5*f*3.

Moreover, when the toner supplying container 5 is inserted, the discharge opening shutter 5*f*3 starts rotation in a α direction around the rotational center 5*f*3*a* (the center in FIG. 9B). When the toner supplying container 5 is completely inserted to the mounted position, the discharge opening shutter 5*f*3 rotates to a position shown in the right in FIG. 9B. Then, the first opening 5*f*5 formed in the toner supplying container 5 and the second opening 5*f*3*b* formed in the discharge opening shutter 5*f*3 coincide with each other to allow discharge of the toner.

Similarly, as shown in FIG. 9A, if the toner supplying container 5 has already been mounted in the apparatus main body 100 already, the discharge opening shutter 5*f*3 is made rotatable in an immobile position. Then, when the process cartridge 1 is inserted, the guide pin 1*e*4 on the inner side formed in the process cartridge 1 is guided by the slit 5*f*2*c* opened in the pressing member 5*f*2 to engage the slit 5*f*3*c* provided in the discharge opening shutter 5*f*3 (the left in FIG. 9A). Since the second opening 5*f*3*b* generates a 90° phase with respect to the first opening 5*f*5 in this state, the first opening 5*f*5 turns into a state in which it is closed by the discharge opening shutter 5*f*3.

Moreover, when the process cartridge 1 is inserted, the discharge opening shutter 5*f*3 starts rotation in a α direction around the rotational center 5*f*3*a* (the center in FIG. 9A). When the process cartridge 1 is completely inserted to the mounted position, the discharge opening shutter 5*f*3 rotates to a position shown in the right in FIG. 9A. Then, the first opening 5*f*5 formed in the toner supplying container 5 and the second opening 5*f*3*b* formed in the discharge opening shutter 5*f*3 coincide with each other to allow discharge of the toner.

Further, it is needless to mention that the position of the first opening 5*f*5 formed in the toner supplying container 5 and the position of the supply opening 1*b*1 formed in the process cartridge 1 coincide with each other in the states shown in the right in FIG. 9A and the right in FIG. 9B.

Figure 13:
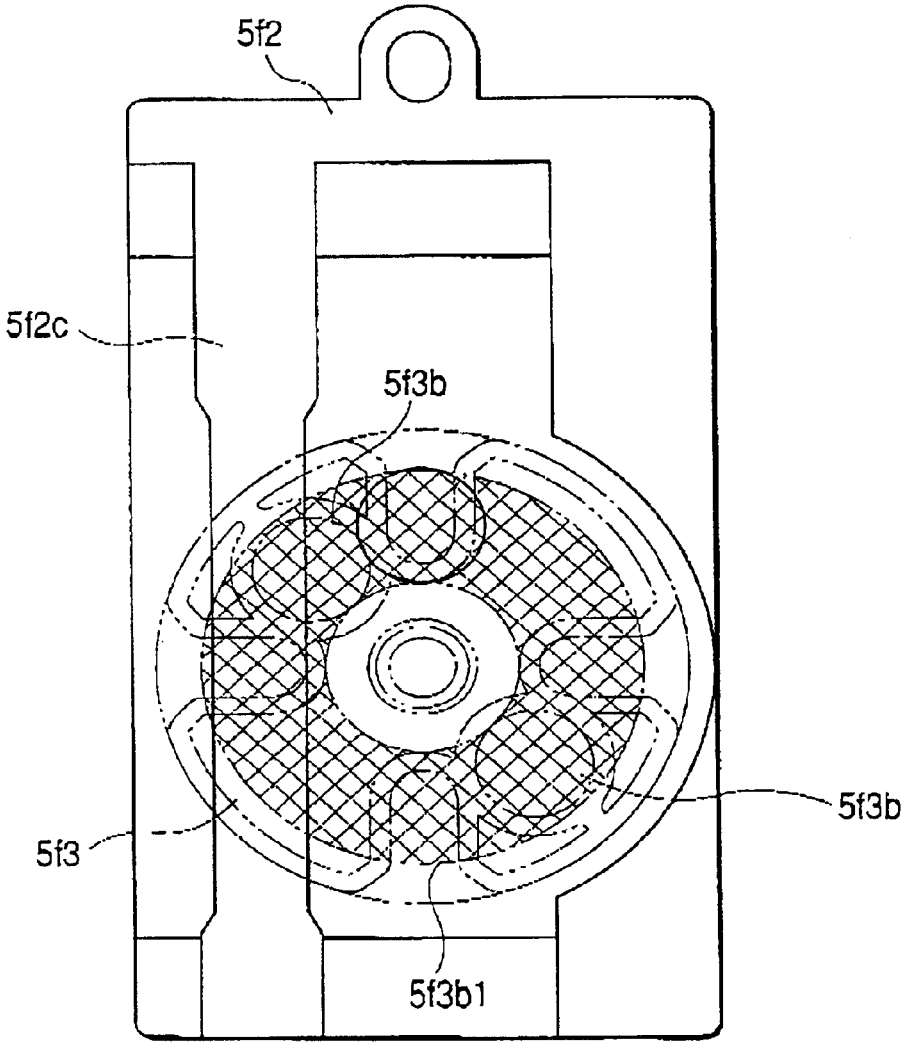
FIG. 13 is a schematic view showing a relationship between a slit opened in the pressing member and a moving locus of a second opening opened in the discharge opening shutter of the toner supplying container in accordance with the present invention.
Figure 14:
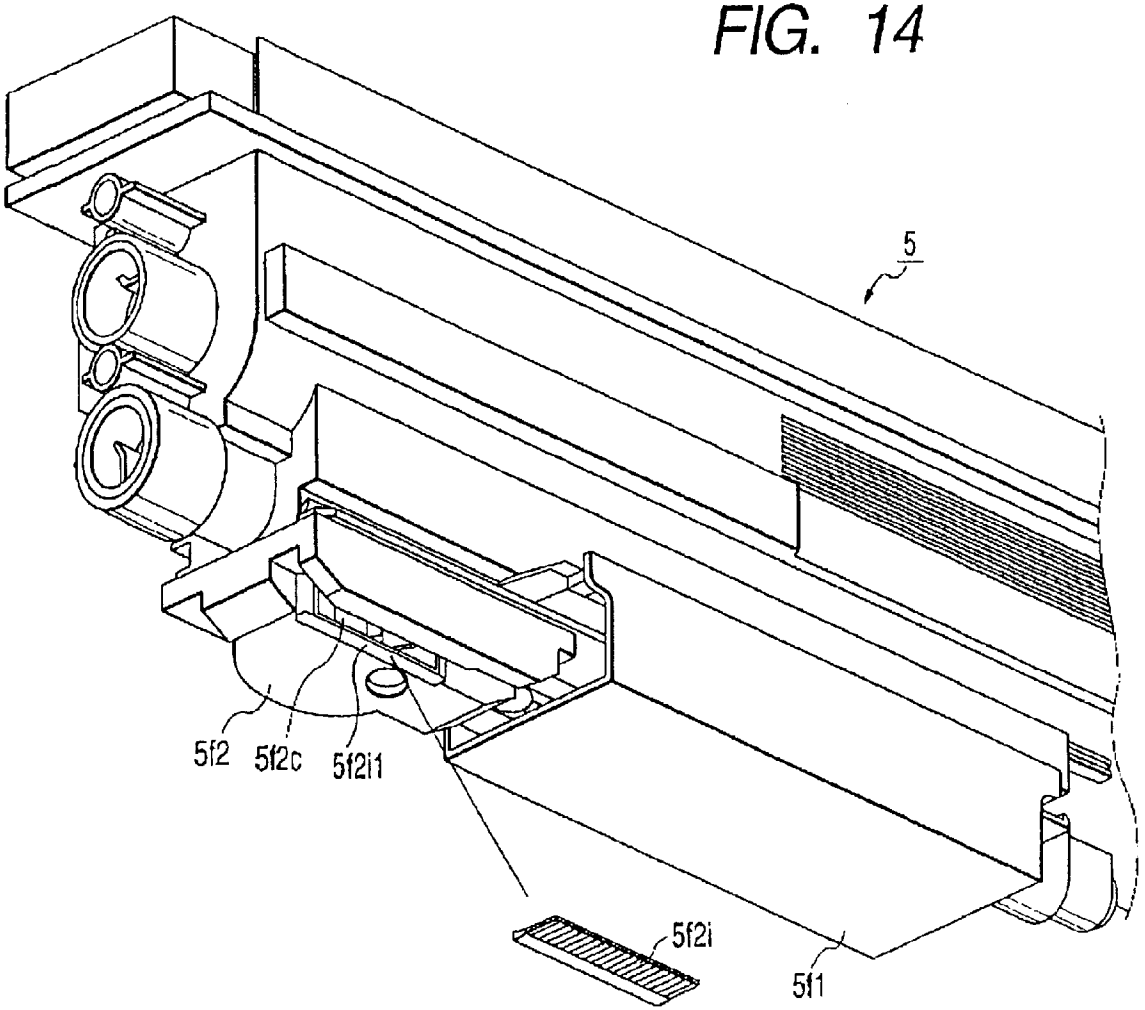
FIG. 14 is a perspective view showing the discharge opening portion of the toner supplying container in accordance with the present invention.

However, since the discharge opening shutter 5*f*3 is associated with insertion and pulling out of both of the process cartridge 1 and the toner supplying container 5, the second opening 5*f*3*b* draws a moving locus 5*f*3*b*1 (area shown by grids) as shown in FIG. 13. Thus, the second opening 5*f*3*b* opposes the slit 5*f*2*c* in a certain area of the moving locus 5*f*3*b*1. In particular, when the discharge opening shutter 5*f*3 is in a closed state, the second opening 5*f*3*b* surely opposes the slit 5*f*2*c*. The second opening 5*f*3*b* is a hole through which toner passes and it is highly likely that toner is adhered to its wall surface. Therefore, it is possible that the toner adhered to the wall surface scatters to the outside from the slit 5*f*2*c* by vibration or the like in the inserting and pulling out operations of the process cartridge 1 and the toner supplying container 5.

In a state in which the toner supplying container 5 is removed from the apparatus main body 100, since the slit 5*f*2*c* is covered by the discharge opening cover 5*f*1, toner does not make, for example, a user hand or cloths dirty.

However, the toner may make the circumference of the guide pins 1*e*4 of the process cartridge 1 dirty in the apparatus main body 100.

Figure 10:
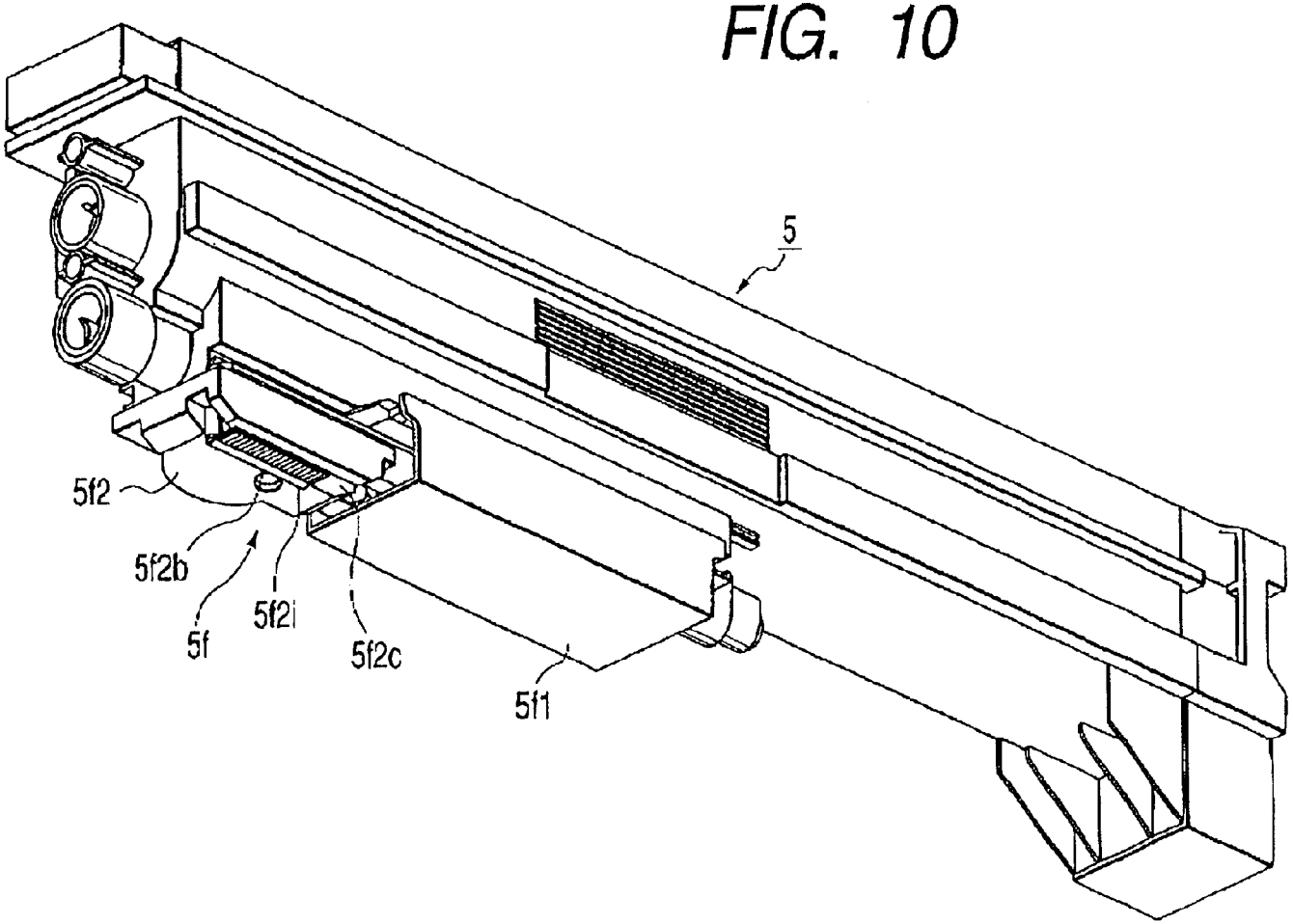
FIG. 10 is a perspective view showing a state in which the discharge opening cover of the toner supplying container in accordance with the present invention is open.

FIG. 10 is a perspective view of the toner supplying container 5 in accordance with the present invention viewed diagonally from the bottom surface side on its inner side. The figure shows a state in which the discharge opening cover 5*f*1 retracts in a position for exposing the discharge opening portion 5*f*.

As shown in the figure, the slit 5*f*2*c* opened in the pressing member 5*f*2 is covered by the brush curtain 5*f*2*i*.

FIGS. 11A and 11B schematically show a function of the brush curtain 5*f*2*i*. FIG. 11A shows the toner supplying container 5 viewed from its bottom surface direction and also shows the pressing member 5*f*2, the discharge opening shutter 5*f*3, the guide pin 1*e*4 and the brush curtain 5*f*2*i*. FIG. 11B is a longitudinal section in an illustrated position of FIG. 11A.

A tip of a brush of the brush curtain 5*f*2*i* points in a direction crossing the longitudinal direction of the slit 5*f*2*c*. As shown in FIGS. 11A and 11B, when the guide pin 1*e*4 passes through the slit 5*f*2*c*, the brush curtain 5*f*2*i* retracts only at the part of the guide pin 1*e*4 to allow the slit 5*f*3*c* of the discharge opening shutter 5*f*3 and the guide pin 1*e*4 to engage with each other. The guide pin 1*e*4 and the slit 5*f*3*c* engage with each other as described above and the discharge opening shutter 5*f*3 performs opening and closing operations following the movement of the guide pin 1*e*4. At this point, although the brush at the part of the guide pin 1*e*4 retracts from the guide pin 1*e*4 because the brush of the brush curtain 5*f*2*i* is flexible, the part of the slit 5*f*2*c* where the guide pin 1*e*4 does not exist is covered by the brush curtain 5*f*2*i*. This retracting part moves following the movement of the guide pin 1*e*4 and the brush curtain 512*i* covers the slit 5*f*2*c* in the other parts. Even if the second opening 5*f*3*b* moves to an area opposing the slit 5*f*2*c*, since the slit 5*f*2*c* is covered by the brush curtain 5*f*2*i* as described above, toner does not scatter to the outside.

Next, an attaching position of the brush curtain 5f2i will be described.

In this embodiment, the brush curtain 5f2i is disposed on an external wall surface of the pressing member 5f2 as shown in the sectional view FIG. 11B of FIG. 11A. This is for preventing peeling of the brush by the guide pin 1e4. That is, as shown in the figure, the brush bends upward by the guide pin 1e4 and, if the brush curtain 5f2i is disposed on an internal wall part, a load acts in the direction in which the brush peels. Thus, the attaching strength of the brush curtain 5f2i must be increased by an amount equivalent to the load.

Further, although the brush curtain 5f2i is adhered to a predetermined position 5f2i 1 of the pressing member 5f2 by a double-faced adhesive tape (see FIG. 14) in this embodiment, as a fixing method of the brush curtain 5f2i, an adhesive, a heat seal and the like can be appropriately selected.

In addition, as a material of the brush, any material may be appropriately selected as long as it is flexible. For example, a chemical fiber, such as nylon and polypropylene, an animal fiber, such as horse hair and pig hair, and a plant fiber, such as hemp and palm, can be used.

Moreover, as a form of fiber forming the brush, a curly hair type can be selected other than the usual straight hair type. If a space in the height direction of the attaching part of the brush curtain 5f2i cannot be secured sufficiently, the density of the brush falls and, as a result, it is possible that toner scatters from gaps in the fiber of the brush. However, if the curly hair type brush fiber is used as the brush, there is an advantage in that toner can be prevented from scattering to the outside because the volume of the brush increases by the curling of the fiber.

Figure 15A:
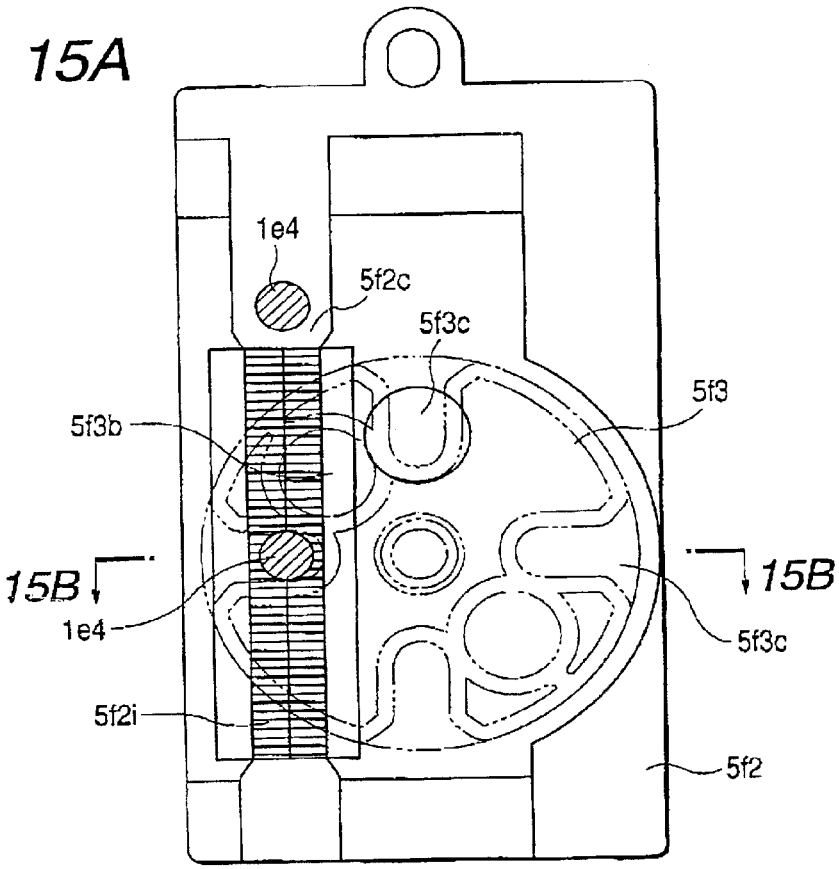
FIG. 15A is a schematic view showing the pressing member, the discharge opening shutter, the brush curtain and the guide pin of the toner supplying container in accordance with the present invention.
Figure 15B:
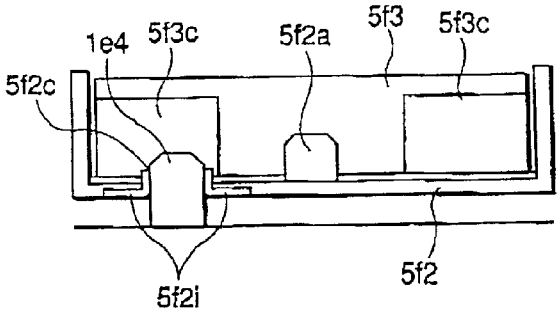
FIG. 15B is a sectional view thereof in an illustrated position of FIG. 15A.

The above descriptions are concerning the form in which bristles extend from one side of the slit. However, as shown in FIGS. 15A and 15B, the brush curtain 5f2i is constituted of two brushes whose tips of bristles point to the center of the slit 5f2c from both sides of the slit 5f2c, whereby toner can be prevented from scattering.

Further, the above description describes the configuration in which the brush curtain covers the slit, through which the convex part for opening and closing the discharge opening shutter provided in a holding member for holding the discharge opening shutter open-closable passes. However, in a configuration in which it is possible that toner scatters from an opening through which the convex part for moving a certain member passes, scattering of toner can be easily prevented if this opening is covered by a brush member whose tips of bristles point to the direction crossing with respect to the moving direction of the convex part.

While the described embodiment represents the preferred form the present invention, it is to be understood that modifications will occur to those skilled in that art without departing from the spirit of the invention. The scope of the invention is therefore to be determined solely by the appended claims.

What is claimed is:

1. A part of an image forming apparatus comprising:

developing means for developing a latent image formed on an image bearing member with a developer; and a unit detachably attachable to a main assembly of the image forming apparatus, wherein said unit includes a discharge opening for discharging the developer, a groove covered with a brush member, and a shutter configured and positioned to open said discharge opening by a movement of a moving body along said groove, wherein the moving body pushes aside a part of the brush member contacting the moving body by the movement of the moving body.

2. A part of an image forming apparatus according to claim 1, wherein the brush member has tips of bristles pointing in a direction crossing a moving direction of the moving body.

3. A part of an image forming apparatus according to claim 1, wherein said developing means is detachably attachable to the main assembly of the image forming apparatus and the moving body is attached to said developing means.

4. A part of an image forming apparatus according to claim 3, wherein the opening and closing of said discharge opening by said shutter is effected by relative movements of said unit and said developing means.

5. A part of an image forming apparatus according to claim 1, wherein said shutter has a hole through which the developer passes and the hole is movable to a position where the hole overlaps said groove.

6. A part of an image forming apparatus comprising:

developing means, detachably attachable to a main assembly of the image forming apparatus, for developing a latent image formed on an image bearing member with a developer; and a supplying container configured and positioned to contain the developer to be supplied to said developing means, wherein said supplying container includes a discharge opening for discharging the developer, a groove covered with a brush member, and a shutter configured and positioned to open said discharge opening by a movement of a moving body along said groove, wherein the moving body pushes aside a part of the brush member contacting the moving body by the movement of the moving body.

7. A part of an image forming apparatus according to claim 6, wherein the brush member has tips of bristles pointing in a direction crossing a moving direction of the moving body.

8. A part of an image forming apparatus according to claim 6, wherein the moving body is attached to said developing means.

9. A part of an image forming apparatus according to claim 6, wherein said shutter has a hole through which the developer passes, the hole being movable to a position where the hole overlaps said groove.

10. A unit detachably attachable to an image forming apparatus, comprising:

a groove in which a moving body is movable, relative to said unit; and a brush member attached at a peripheral portion of said groove to cover said groove, wherein, when the moving body passes through said groove, the moving body pushes aside a part of said brush member by a movement of the moving body.

11. A unit detachably attachable to an image forming apparatus according to claim 10, wherein said brush member has tips of bristles pointing in a direction crossing a relative moving direction of the moving body.

12. A unit detachably attachable to an image forming apparatus according to claim 10, wherein said unit has a containing portion configured to contain a developer.

13. A unit detachably attachable to an image forming apparatus according to claim 12, wherein said unit further comprises a discharge opening for discharging a developer and a shutter configured and positioned to open said discharge opening, and wherein the opening and closing of said discharge opening by said shutter is effected by relative movement of said unit and the moving body.

14. A unit detachably attachable to an image forming apparatus according to claim 13, wherein said shutter has a hole through which the developer passes, the hole being movable to a position where the hole overlaps said groove.

* * * * *